US010125568B2

(12) United States Patent
Fripp et al.

(10) Patent No.: US 10,125,568 B2
(45) Date of Patent: Nov. 13, 2018

(54) SUBTERRANEAN FORMATION OPERATIONS USING DEGRADABLE WELLBORE ISOLATION DEVICES

(71) Applicant: Halliburton Energy Services, Inc., Houston, TX (US)

(72) Inventors: Michael Linley Fripp, Carrollton, TX (US); Zachary William Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 236 days.

(21) Appl. No.: 14/896,684

(22) PCT Filed: Aug. 13, 2015

(86) PCT No.: PCT/US2015/044993
§ 371 (c)(1),
(2) Date: Dec. 8, 2015

(87) PCT Pub. No.: WO2016/032761
PCT Pub. Date: Mar. 3, 2016

(65) Prior Publication Data

US 2016/0201427 A1 Jul. 14, 2016

Related U.S. Application Data

(63) Continuation of application No. PCT/US2014/053212, filed on Aug. 28, 2014.

(51) Int. Cl.
*E21B 33/134* (2006.01)
*E21B 33/12* (2006.01)

(52) U.S. Cl.
CPC ..... *E21B 33/134* (2013.01); *E21B 33/1208* (2013.01)

(58) Field of Classification Search
CPC ..... E21B 33/134; E21B 33/1208
See application file for complete search history.

(56) References Cited

U.S. PATENT DOCUMENTS 4,655,852 A 4/1987 Rallis
5,984,007 A 11/1999 Yuan et al.
(Continued)

FOREIGN PATENT DOCUMENTS

CA 2886988 C 8/2017
WO 2005090742 A1 9/2005
(Continued)

OTHER PUBLICATIONS

Ginger Gardiner, "Composites boon from hyrdaulic fracturing?" CompositesWorld, Jan. 8, 2014, XP055267997, obtained from http://www.compositesworld.com/blog/post/composites-boon-from-hydraulic-fracturing.

(Continued)

*Primary Examiner* — Michael R Wills, III
(74) *Attorney, Agent, or Firm* — McGuire Woods LLP

(57) ABSTRACT

Methods including introducing a frac plug into a wellbore in a subterranean formation, the frac plug comprising at least a mandrel, slips, and a packer element, wherein at least a portion of the mandrel and/or the slips is composed of a degradable alloy selected from the group consisting of a magnesium alloy, an aluminum alloy, and any combination thereof. The wellbore may be a cased wellbore or an open-hole wellbore, and wherein the slips are frictionally engaged with the casing string or the wellbore wall and the packer element is compressed against the casing or the wellbore wall to set the frac plug. One or more perforations is created within the formation and the formation is hydraulically fractured. The frac plug is at least partially degraded (Continued)

upon contact with an electrolyte in the wellbore before or after beginning production of a hydrocarbon.

20 Claims, 3 Drawing Sheets

(56) References Cited

U.S. PATENT DOCUMENTS 7,168,494 B2 1/2007 Starr et al.
7,350,582 B2 4/2008 McKeachnie et al.
7,353,879 B2 4/2008 Todd et al.
7,690,436 B2 4/2010 Turley et al.
8,211,248 B2 7/2012 Marya
8,267,177 B1 9/2012 Vogel et al.
8,413,727 B2 4/2013 Holmes
8,573,295 B2 11/2013 Johnson et al.
8,695,714 B2 4/2014 Xu et al.
8,746,342 B1 6/2014 Nish et al.
8,905,147 B2 12/2014 Fripp et al.
9,016,363 B2 4/2015 Xu et al.
9,217,319 B2 12/2015 Frazier et al.
9,309,744 B2 4/2016 Frazier
2005/0205265 A1* 9/2005 Todd ..... E21B 23/00 166/376
2006/0131031 A1 6/2006 McKeachnie et al.
2006/0278405 A1 12/2006 Turley et al.
2007/0074873 A1 4/2007 McKeachnie et al.
2007/0181224 A1* 8/2007 Marya ..... C09K 8/805 148/400
2008/0149345 A1 6/2008 Marya et al.
2010/0270031 A1 10/2010 Patel
2011/0048743 A1* 3/2011 Stafford ..... E21B 33/134 166/386
2011/0067889 A1* 3/2011 Marya ..... E21B 33/134 166/386
2011/0132621 A1 6/2011 Agrawal et al.
2012/0097384 A1 4/2012 Valencia et al.
2012/0125642 A1 5/2012 Chenault et al.
2012/0292053 A1 11/2012 Xu et al.
2012/0318513 A1 12/2012 Mazyar et al.
2013/0048305 A1 2/2013 Xu et al.
2013/0112429 A1* 5/2013 Crews ..... C09K 8/52 166/376
2013/0240200 A1* 9/2013 Frazier ..... E21B 33/134 166/135
2013/0292123 A1* 11/2013 Murphree ..... E21B 34/14 166/308.1
2013/0327540 A1 12/2013 Hamid et al.
2013/0333890 A1* 12/2013 Dagenais ..... E21B 29/00 166/302
2014/0027128 A1 1/2014 Johnson et al.
2014/0190685 A1 7/2014 Frazier et al.
2014/0190705 A1 7/2014 Fripp et al.
2014/0224477 A1 8/2014 Wiese et al.
2014/0262327 A1* 9/2014 Xu ..... E21B 29/00 166/376
2014/0305627 A1 10/2014 Manke
2015/0053428 A1* 2/2015 Xu ..... E21B 33/128 166/386
2015/0060085 A1* 3/2015 Xu ..... E21B 29/02 166/376
2015/0247376 A1* 9/2015 Tolman ..... E21B 33/12 166/297
2015/0354311 A1 12/2015 Okura et al.
2016/0230498 A1 8/2016 Walton et al.
2016/0251934 A1 9/2016 Walton et al.
2016/0298412 A1 10/2016 Fripp et al.

FOREIGN PATENT DOCUMENTS

WO WO-2013109287 A1 7/2013
WO 2014100141 A2 6/2014
WO 2015171126 A1 11/2015
WO 2016032493 A1 3/2016
WO 2016032620 A1 3/2016
WO 2016032621 A1 3/2016
WO 2016032761 A1 3/2016

OTHER PUBLICATIONS

Search Report received in corresponding Netherlands Application No. 1041449, dated May 17, 2016.
Canadian Office Action from Canadian Patent Application No. 2,955,922; dated Dec. 8, 2017, 3 pages.
Australian Examination Report from Australian Patent Application No. 2015307211, dated Feb. 5, 2018, 5 pages.
International Search Report and Written Opinion for PCT/US2015/044993 dated Oct. 23, 2015.

* cited by examiner

SUBTERRANEAN FORMATION OPERATIONS USING DEGRADABLE WELLBORE ISOLATION DEVICES

CROSS-REFERENCE TO RELATED APPLICATIONS

This application claims priority to PCT/US2014/053212 filed on Aug. 28, 2014 entitled "Degradable Wellbore Isolation Devices with Large Flow Areas."

BACKGROUND

The present disclosure generally relates to downhole tools used in the oil and gas industry and, more particularly, to subterranean formation operations using degradable wellbore isolation device downhole tools.

In the drilling, completion, and stimulation of hydrocarbon-producing wells, a variety of downhole tools are used. For example, it is often desirable to seal portions of a wellbore, such as during fracturing operations when various fluids and slurries are pumped from the surface into a casing string that lines the wellbore, and forced out into a surrounding subterranean formation through the casing string. It thus becomes necessary to seal the wellbore and thereby provide zonal isolation at the location of the desired subterranean formation. Wellbore isolation devices, such as packers, bridge plugs, and fracturing plugs (i.e., "frac" plugs), are designed for these general purposes and are well known in the art of producing hydrocarbons, such as oil and gas. Such wellbore isolation devices may be used in direct contact with the formation face of the wellbore, with a casing string extended and secured within the wellbore, or with a screen or wire mesh.

After the desired downhole operation is complete, the seal formed by the wellbore isolation device must be broken and the tool itself removed from the wellbore. Removing the wellbore isolation device may allow hydrocarbon production operations to commence without being hindered by the presence of the downhole tool. Removing wellbore isolation devices, however, is traditionally accomplished by a complex retrieval operation that involves milling or drilling out a portion of the wellbore isolation device, and subsequently mechanically retrieving its remaining portions. To accomplish this, a tool string having a mill or drill bit attached to its distal end is introduced into the wellbore and conveyed to the wellbore isolation device to mill or drill out the wellbore isolation device. After drilling out the wellbore isolation device, the remaining portions of the wellbore isolation device may be grasped onto and retrieved back to the surface with the tool string for disposal. As can be appreciated, this retrieval operation can be a costly and time-consuming process.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
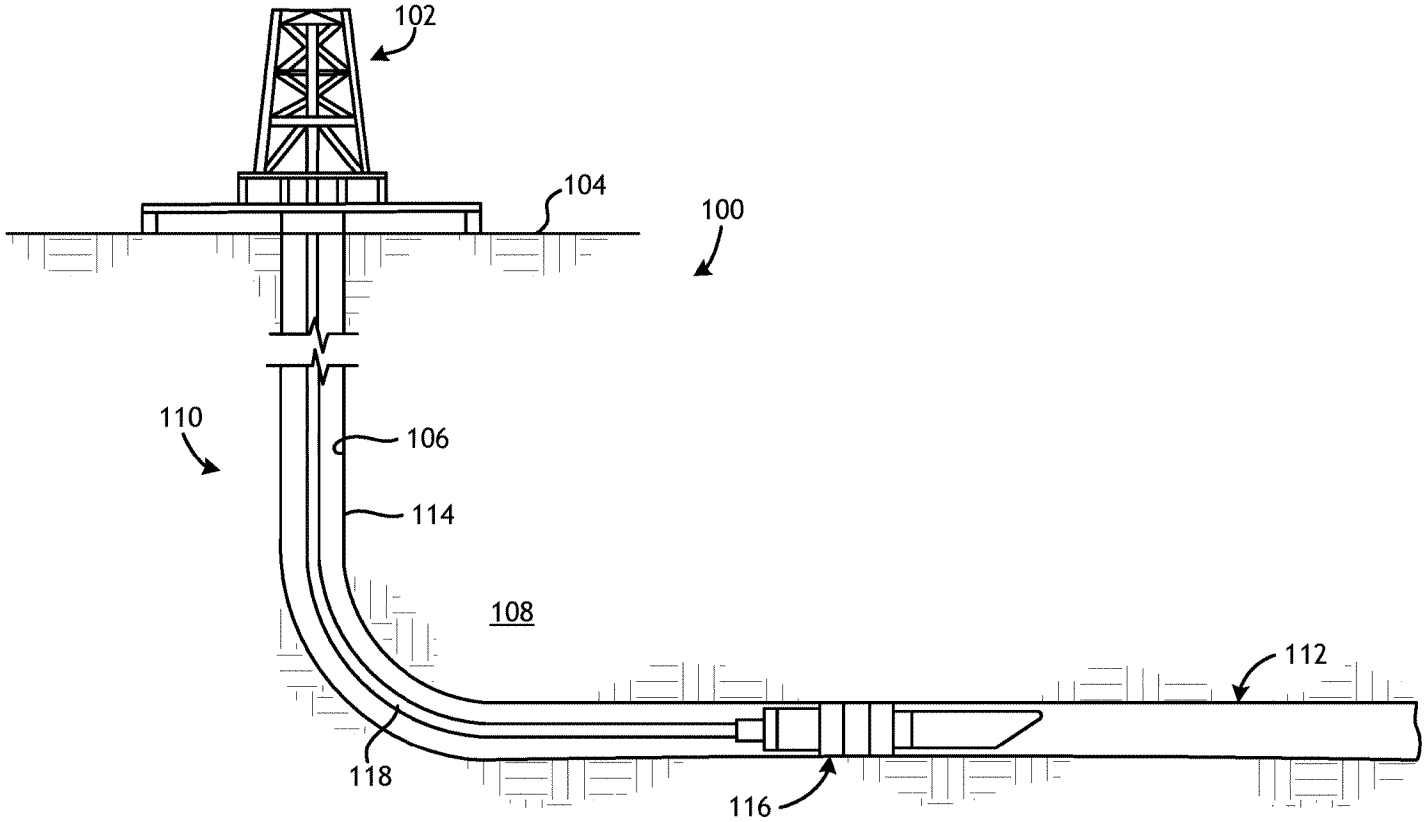
FIG. 1 is a well system that can employ one or more principles of the present disclosure, according to one or more embodiments.

The present disclosure generally relates to downhole tools used in the oil and gas industry and, more particularly, to subterranean formation operations using degradable wellbore isolation device downhole tools.

The present disclosure describes embodiments of wellbore isolation devices that are made of degrading materials, and their methods of use during a subterranean formation operation. In particular, the present disclosure describes wellbore isolation devices having a variety of components, such as a mandrel, a frac ball, and an expandable or inflatable packer element, wherein one or more of the variety of components is composed of a degradable material that degrades in a wellbore environment at a desired time during the performance of a subterranean formation operation (or simply "formation operation"). These degradable materials (also referred to collectively as "degradable substances") are discussed in greater detail below. As used herein, the term "wellbore isolation device," and grammatical variants thereof, is a device that is set in a wellbore to isolate a portion of the wellbore thereabove from a portion therebelow so that fluid can be forced into the surrounding subterranean formation above the device. As used herein, the term "sealing ball" and "frac ball," and grammatical variants thereof, refer to a spherical or spheroidal element designed to seal perforations of a wellbore isolation device that are accepting fluid, thereby diverting reservoir treatments to other portions of a target zone in a subterranean formation. An example of a sealing ball is a frac ball in a frac plug wellbore isolation device. As used herein, the term "packer element," and grammatical variants thereof, refers to an expandable, inflatable, or swellable element that expands against a casing or wellbore to seal the wellbore.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of each numerical value. For example, if the numerical value is "about 80%," then it can be 80% +/−5%, equivalent to 76% to 84%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The embodiments of the present disclosure are directed toward degradable wellbore isolation devices (e.g., frac plugs) comprising at least one degradable component. As used herein, the term "degradable" and all of its grammatical variants (e.g., "degrade," "degradation," "degrading," "dissolve," dissolving," and the like), refers to the dissolution or chemical conversion of solid materials such that reduced-mass solid end products result or reduced structural integrity results by at least one of solubilization, hydrolytic degradation, biologically formed entities (e.g., bacteria or enzymes), chemical reactions (including electrochemical and galvanic reactions), thermal reactions, reactions induced by radiation, or combinations thereof. In complete degradation, no solid end products result, or structural shape is lost. In some instances, the degradation of the material may be sufficient for the mechanical properties of the material to be reduced to a point that the material no longer maintains its integrity and, in essence, falls apart or sloughs off into its surroundings. The conditions for degradation are generally wellbore conditions where an external stimulus may be used to initiate or effect the rate of degradation, where the external stimulus is naturally occurring in the wellbore (e.g., pressure, temperature) or introduced into the wellbore (e.g., fluids, chemicals). For example, the pH of the fluid that interacts with the material may be changed by introduction of an acid or a base, or an electrolyte may be introduced or naturally occurring to induce galvanic corrosion. The term "wellbore environment," and grammatical variants thereof, includes both naturally occurring wellbore environments and materials or fluids introduced into the wellbore. The term "at least a portion," and grammatical variants thereof, with reference to a component having at least a portion composed thereof of a degradable material or substance (e.g., "at least a portion of a component is degradable" or "at least a portion of the mandrel and/or slips is degradable," and variants thereof) refers to at least about 80% of the volume of that part being formed of the degradable material or substance.

The degradable materials for forming a component of the wellbore isolation device may allow for time between setting the wellbore isolation device and when a particular downhole operation is undertaken, such as a hydraulic fracturing operation). Moreover, degradable materials allow for acid treatments and acidified stimulation of a wellbore. In some embodiments, the degradable materials may require a greater flow area or flow capacity to enable production operations without unreasonably impeding or obstructing fluid flow while the wellbore isolation device degrades. As a result, production operations may be efficiently undertaken while the wellbore isolation device degrades and without creating significant pressure restrictions.

As stated above, the embodiments of the present disclosure relate to methods of using a degradable wellbore isolation device, and in particular, a frac plug, during a hydraulic fracturing operation. For example, a frac plug may be introduced into a wellbore in a subterranean formation in accordance with the embodiments described herein. The wellbore may be an open-hole wellbore or have a casing string disposed therein. The frac plug comprises a plurality of components comprising at least a mandrel, slips, and a packer element. At least a portion of the mandrel and/or the slips is composed of a degradable metal material that is a degradable alloy, wherein the degradable alloy is a magnesium alloy, and aluminum alloy, or a combination thereof. Other components of the frac plug may additionally be comprised of a degradable material, including any degradable metal material (e.g., a degradable alloy) or a degradable elastomer, such as the packer element, without departing from the scope of the present disclosure. For example, in some embodiments, the frac plug comprises a frac ball that seats on a ball seat to create a fluid seal within the wellbore, as discussed in greater detail below. The frac ball may in some embodiments be a degradable metal material or a degradable elastomer, such that upon degradation, fluid flow is restored through the frac plug.

The slips frictionally engage the wall of the wellbore or the casing string, depending on the configuration of the wellbore in the subterranean formation. As used herein, the term "wall," and grammatical variants thereof (e.g., wellbore wall), with reference to a wellbore refers to the outer rock face that bounds the drilled wellbore. The packer element of the frac plug is compressed against wall of the wellbore or the casing string to set the frac plug within the wellbore, as described below. At least one perforation is created in the subterranean formation though the wall of the wellbore or the casing string (and any cement disposed between the wall of the wellbore and the casing string, if included). In some embodiments, a plurality of perforations, or a perforation cluster are created into the subterranean formation, without departing from the scope of the present disclosure. As used herein, the term "perforation," and grammatical variants thereof, refers to a communication tunnel created through a wall of a wellbore, including through a casing string, into a subterranean formation through which production fluids may flow. Perforations may be formed by any means suitable in a subterranean formation including, but not limited to, shaped explosive charges, perforating guns, bullet perforating, abrasive jetting, or high-pressure fluid jetting, without departing from the scope of the present disclosure.

The subterranean formation is hydraulically fractured through the at least one perforation. As used herein, the term "hydraulic fracturing," and grammatical variants thereof, refers to a stimulation treatment in which fluids are pumped at high rate and pressure to overcome a fracture gradient within a subterranean formation to cause fractures to be created or enhanced. The term "fracture gradient," and grammatical variants thereof, refers to the pressure required to induce or enhance fractures in a subterranean formation at a given depth. That is, the fracture gradient may vary in a particular subterranean formation depending on the depth thereof.

The one or more components of the frac plug made of a degradable material is degraded at least partially in the wellbore environment. As used herein, the term "at least partially degrading," and grammatical variants thereof (e.g., "degrading at least partially," "partially degrades," and the like) with reference to degradation of the frac plug 200 or component thereof refers to the plug or component degrading at least to the point wherein about 20% or more of the mass of the plug or component degrades. For instance, the degradable alloy forming at least a portion of either or both of the mandrel and/or slips of the frac plug is at least partially degraded in the presence of an electrolyte in the wellbore environment. The production of a hydrocarbon (i.e., oil and/or gas) from the subterranean formation may proceed. The order of the degradation of the degradable material forming the frac plug and the production of a hydrocarbon may occur simultaneously, or in series, without departing from the scope of the present disclosure. That is, the order, if any, may depend on selection of the particular degradable material (e.g., the degradable alloy or alloy combination), the degradation stimuli (e.g., the electrolyte or other stimulus), and the like, and any combination thereof. In some embodiments, accordingly, production may begin before degradation, or degradation may begin before production. Although degradation may begin and end before production begins, it is contemplated that both degradation and production will occur simultaneously at at least some point in time (or duration), regardless of which process is initiated first.

Referring to FIG. 1, illustrated is a well system 100 that may embody or otherwise employ one or more principles of the present disclosure, according to one or more embodiments. As illustrated, the well system 100 may include a service rig 102 (also referred to as a "derrick") that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112, although such deviation is not required. That is, the wellbore 106 may be vertical, horizontal, or deviated, without departing from the scope of the present disclosure. In some embodiments, the wellbore 106 may be completed by cementing a string of casing 114 within the wellbore 106 along all or a portion thereof. As used herein, the term "casing" refers not only to casing as generally known in the art, but also to borehole liner, which comprises tubular sections coupled end to end but not extending to a surface location. In other embodiments, however, the string of casing 114 may be omitted from all or a portion of the wellbore 106 and the principles of the present disclosure may equally apply to an "open-hole" environment.

The well system 100 may further include a wellbore isolation device 116 that may be conveyed into the wellbore 106 on a conveyance 118 (also referred to as a "tool string") that extends from the service rig 102. The wellbore isolation device 116 may include or otherwise comprise any type of casing or borehole isolation device known to those skilled in the art including, but not limited to, a frac plug, a deployable baffle, a wellbore packer, a wiper plug, a cement plug, or any combination thereof. Of focus of the current disclosure is a frac plug. As used herein, the term "frac plug" (also referred to as a "fracturing plug"), and grammatical variants thereof, refers to a wellbore isolation device that isolates fluid flow in at least one direction relative to the plug, typically the isolation is from above the plug. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location (not shown) within the wellbore 106. At the target location, the wellbore isolation device may be actuated or "set" to seal the wellbore 106 and otherwise provide a point of fluid isolation within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and provides the necessary power to actuate and set the wellbore isolation device 116 upon reaching the target location. In other embodiments, the wellbore isolation device 116 freely falls to the target location under the force of gravity to traverse all or part of the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted. It should also be noted that a plurality of wellbore isolation devices 116 may be placed in the wellbore 106. In some embodiments, for example, several (e.g., six or more) wellbore isolation devices 116 may be arranged in the wellbore 106 to divide the wellbore 106 into smaller intervals or "zones" for hydraulic stimulation.

Figure 2:
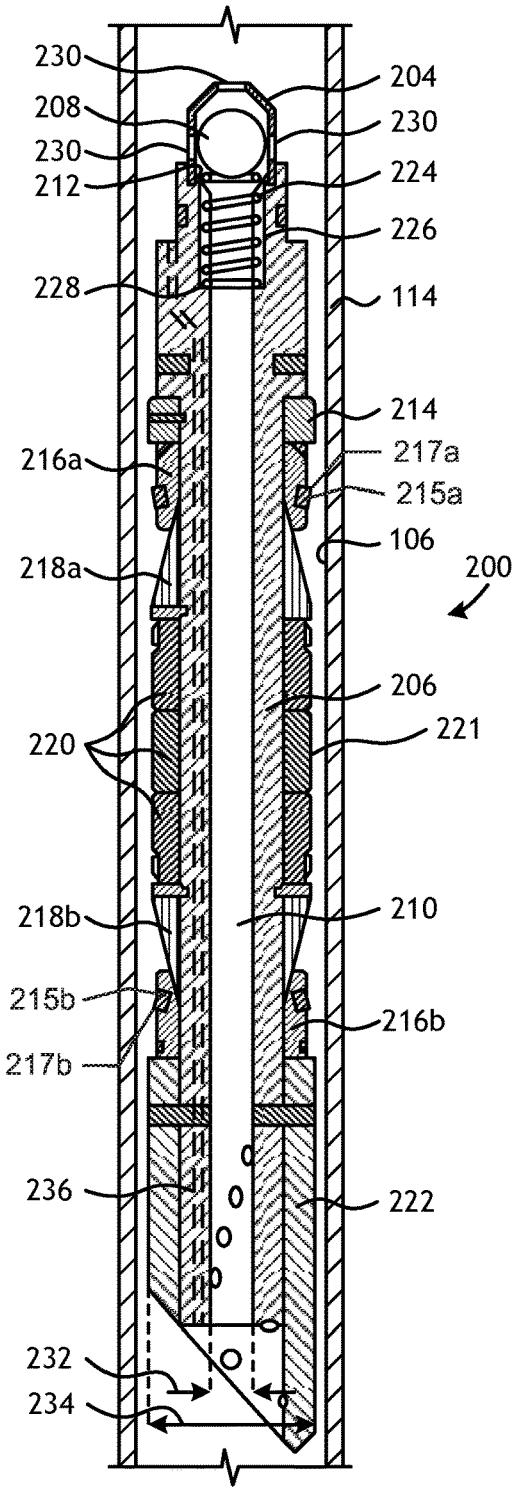
FIG. 2 is a cross-sectional side view of an frac plug that can employ the principles of the present disclosure.

Referring now to FIG. 2, with continued reference to FIG. 1, illustrated is a cross-sectional view of an exemplary frac plug 200 that may employ one or more of the principles of the present disclosure, according to one or more embodiments. The frac plug 200 may be similar to or the same as the wellbore isolation device 116 of FIG. 1. Accordingly, the frac plug 200 may be configured to be extended into and seal the wellbore 106 at a target location, and thereby prevent fluid flow past the frac plug 200 for wellbore completion or stimulation operations. In some embodiments, as illustrated, the wellbore 106 may be lined with the casing 114 or another type of wellbore liner or tubing in which the frac plug 200 may suitably be set. In other embodiments, however, the casing 114 may be omitted and the frac plug 200 may instead be set or otherwise deployed in an uncompleted or "open-hole" environment.

As illustrated, the frac plug 200 may include a ball cage 204 extending from or otherwise coupled to the upper end of a mandrel 206. A sealing ball, frac ball 208, is disposed in the ball cage 204 and the mandrel 206 defines a longitudinal central flow passage 210. The mandrel 206 also defines a ball seat 212 at its upper end. In other embodiments, the frac ball 208 may be dropped into the conveyance 118 (FIG. 1) to land on top of the frac plug 200 rather than being carried within the ball cage 204.

One or more spacer rings 214 (one shown) may be secured to the mandrel 206 and otherwise extend thereabout. The spacer ring 214 provides an abutment, which axially retains a set of upper slips 216*a* that are also positioned circumferentially about the mandrel 206. As illustrated, a set of lower slips 216*b* may be arranged distally from the upper slips 216*a*. The upper slips 216*a* have slip inserts 215*a* embedded therein; and the lower slips 216*b* have slip inserts 215*b* embedded therein. As used herein, the term "embedded" means at least partially enclosed within a supporting substance material. Accordingly, the slip inserts 215*a*, 215*b* are embedded, i.e., at least partially enclosed with the supporting upper and lower slips 216*a*, 216*b*, respectively. The slip inserts 215*a*, 215*b* may be embedded in the slips 216*a*, 216*b*, respectively, by any known method. Examples of suitable methods may include, but are not limited to, via a press fit, via a thermal shrink fit, via an adhesive, via a snap ring, via a swellable elastomer, and the like.

As a specific example of the slip inserts 215*a*, 215*b* being embedded in the slips 216*a*, 216*b*, as shown in FIG. 2, the slip inserts 215*a*, 215*b* have a leading edge 217*a*, 217*b* respectively that extends outward or protrudes beyond the surface of the body of the slip 216*a*, 216*b*, respectively. The leading edge 217*a*, 217*b* contacts a surface to hold the frac plug 200 at a location within a wellbore (e.g., frictionally engages). The leading edge 217*a*, 217*b* protrudes beyond the body of the slip 216*a*, 216*b* away from the tip of the slip 216*a*, 216*b* that extends outwardly. As depicted, the leading edge 217*a*, 217*b* (or the entire slip insert) may extend outwardly from the slips 216*a*, 216*b* respectively at a preselected angle relative to the outer surface of the slip. That is, the slip inserts 215*a*, 215*b* may be embedded in the slips 216*a*, 216*b* at a preselected angle. In some embodiments, the preselected angle may be in the range of from about 1° to about 45° relative to the surface of the slips 216*a*, 216*b*, encompassing any value and subset therebetween.

Each of slip inserts 215*a*, 215*b* protrude from the slips 216*a*, 216*b* respectively to penetrate or bite a downhole surface and frictionally engage the slips 216*a,b* therewith (e.g., a wellbore wall, a tubing string wall, such as casing string, and the like). Although each slip 216*a*, 216*b* is shown having two slip inserts 215*a*, 215*b* respectfully, it will be appreciated that any number of slip inserts, including one or a plurality (three, four, five, ten, twenty, and the like) of slip inserts may be embedded in each slip, without departing from the scope of the present disclosure. Moreover, the number of slip inserts in the upper slips 216*a* and lower slips 216*b*, and any additional slips included as part of the frac plug 200, may have the same or different number of slip inserts, without departing from the scope of the present disclosure. Additionally, although the slip inserts 215*a*, 215*b* shown in FIG. 2 are depicted as rectangular or square in cross section. However, the shape of the slips may be cylindrically shaped, frustrum shaped, conical shaped, spheroid shaped, pyramid shaped, polyhedron shaped, octahedron shaped, cube shaped, prism shaped, hemispheroid shaped, cone shaped, tetrahedron shaped, cuboid shaped, and the like, and any combination thereof, without departing from the scope of the present disclosure. That is, the slip inserts may be partially one shape and partially one or more other shapes.

One or more slip wedges 218 (shown as upper and lower slip wedges 218*a* and 218*b*, respectively) may also be positioned circumferentially about the mandrel 206, as described in greater detail below. Collectively, the term "slip assembly" includes at least the slips (including any slip inserts therein) and slip wedges.

A packer assembly consisting of one or more expandable or inflatable packer elements 220 (also referred to herein collectively as packer element 220) may be disposed between the upper and lower slip wedges 218*a,b* and otherwise arranged about the mandrel 206. It will be appreciated that the particular packer assembly depicted in FIG. 2 is merely representative as there are several packer arrangements known and used within the art. For instance, while three packer elements 220 are shown in FIG. 2, the principles of the present disclosure are equally applicable to wellbore isolation devices that employ more or less than three packer elements 220, without departing from the scope of the disclosure.

A mule shoe 222 may be positioned at or otherwise secured to the mandrel 206 at its lower or distal end. As will be appreciated, the lower most portion of the frac plug 200 need not be a mule shoe 222, but could be any type of section that serves to terminate the structure of the frac plug 200, or otherwise serves as a connector for connecting the frac plug 200 to other tools, such as a valve, tubing, or other downhole equipment.

In some embodiments, a spring 224 may be arranged within a chamber 226 defined in the mandrel 206 and otherwise positioned coaxial with and fluidly coupled to the central flow passage 210. At one end, the spring 224 biases a shoulder 228 defined by the chamber 226 and at its opposing end the spring 224 engages and otherwise supports the frac ball 208. The ball cage 204 may define a plurality of ports 230 (three shown) that allow the flow of fluids therethrough, thereby allowing fluids to flow through the length of the frac plug 200 via the central flow passage 210.

As the frac plug 200 is lowered into the wellbore 106, the spring 224 prevents the frac ball 208 from engaging the ball seat 212. As a result, fluids may pass through the frac plug 200; i.e., through the ports 230 and the central flow passage 210. The ball cage 204 retains the frac ball 208 such that it is not lost during translation into the wellbore 106 to its target location. Once the frac plug 200 reaches the target location, a setting tool (not shown) of a type known in the art can be used to move the frac plug 200 from its unset position (shown in FIG. 2) to a set position. The setting tool may operate via various mechanisms to anchor the frac plug 200 in the wellbore 106 including, but not limited to, hydraulic setting, mechanical setting, setting by swelling, setting by inflation, and the like. In the set position, the slips 216*a,b* and the packer elements 220 expand and engage the inner walls of the casing 114.

When it is desired to seal the wellbore 106 at the target location with the frac plug 200, fluid is injected into the wellbore 106 and conveyed to the frac plug 200 at a predetermined flow rate that overcomes the spring force of the spring 224 and forces the frac ball 208 downwardly until it sealingly engages the ball seat 212. When the frac ball 208 is engaged with the ball seat 212 and the packer elements 220 are in their set position, fluid flow past or through the frac plug 200 in the downhole direction is effectively prevented. That is, the packer elements 220 expand and compress against the inner walls of the casing 114 (or the wall of the wellbore 106 when no casing 114 is present) to set the frac plug 200. The method of expanding the packer elements 220 and compressing them against the casing 112 (or wall of the wellbore 106) may be by any means suitable for setting the frac plug 200. For example, in accordance with the embodiments described herein, in some instances, the packer elements 220 are compressed by stroking the mandrel 206 of the frac plug 200, such that the mandrel 206 strokes in a direction relative to the frac plug 200 causing the packer elements 220 to expand in an axial direction and compress against the casing 125 (or wall of the wellbore 106). In other embodiments, the packer elements 220 have a frangible barrier 221 at least partially surrounding the outer surface thereof, wherein the frangible barrier 221 ruptures or otherwise is compromised to allow expansion of the packer elements 220 and compression against the casing 125 (or wall of the wellbore 106). For example, the frangible barrier 221 may be broken by stroking of the mandrel 206, mere shear contact with the casing 125 or other portions of the wellbore 106, or by other mechanical means, thus exposing the packer elements 220 to the wellbore environment. Thereafter, the packer elements 220 may themselves be swellable or the rupture of the frangible barrier 221 may trigger a mechanical actuation of the frac plug 200 to cause the packer elements 220 to expand and compress against the casing 125 (or wall of the wellbore 106). Other means of compressing the packer elements 220 against the casing 125 (or wall of the wellbore 106) may additionally be appropriate in accordance with the embodiments described herein, without departing from the scope of the present disclosure.

After the frac plug 200 is set, completion or stimulation operations may be undertaken by injecting a treatment or completion fluid into the wellbore 106 and forcing the treatment/completion fluid out of the wellbore 106 and into a subterranean formation above the frac plug 200. Following completion and/or stimulation operations, the frac plug 200 must be removed from the wellbore 106 in order to allow production operations to effectively occur without being excessively hindered by the emplacement of the frac plug 200. According to the present disclosure, various components of the frac plug 200 may be made of one or more degradable materials. In particular, at least the mandrel and/or slips of the frac plug 200 are composed of a degradable metal material. Other components may additionally be made of the degradable metal material, another degradable material (e.g., a degradable elastomer), or a non-degradable material, without departing from the scope of the present disclosure. The degradable materials selected may provide time between setting the frac plug 200 and when a desired completion or stimulation operation is undertaken, such as a hydraulic fracturing operation. As discussed above, the time period between beginning degradation of the frac plug 200 and production of a hydraulically fractured subterranean formation may vary, without departing from the scope of the present disclosure.

In some instances, it may be desirable to increase the flow area or flow capacity through and/or around the frac plug 200. According to the present disclosure, the frac plug 200 may exhibit a large flow area or flow capacity through and/or around the frac plug 200 so that it does not unreasonably impede, obstruct, or inhibit production operations while the frac plug 200 degrades such that it no longer provides a seal. As a result, production operations may be undertaken while the frac plug 200 proceeds to dissolve and/or degrade, and without creating a significant pressure restriction within the wellbore 106.

The frac plug 200 may provide a minimum production flow area across the frac plug 200. As used herein "production flow area across" the frac plug 200 refers to any fluid flow through and/or around the frac plug 200. In some embodiments, the minimum production flow area across the frac plug 200 may be a desired fraction of the total flow area of the wellbore 106 (i.e., the casing 114) at the location of the frac plug 200. More particularly, in at least one embodiment, the frac plug 200 may exhibit a production flow area across the frac plug 200 that is at least 1/25 the total flow area of the wellbore 106 (i.e., the casing 114) at the location of the frac plug 200. In another embodiment, the frac plug 200 may exhibit a production flow area across the frac plug 200 that is at least 1/16 of the total flow area of the wellbore 106 at the location of the frac plug 200. The production flow area across the frac plug 200 may include any fluid flow through the central flow passage 210 and any other flow paths through or around the frac plug 200 that are not necessarily through the central flow passage 210. In some embodiments, for instance, the frac plug 200 may further include one or more conduits or flow channels 236 defined longitudinally through the mandrel 206 or other structural portions of the frac plug 200 through which fluids may flow during production operations.

In other embodiments, the minimum production flow area of the frac plug 200 may correspond to a desired ratio between the inner and outer diameters of the frac plug 200. The term "diameter" with reference to the minimum production flow area refers to the diameter of the cross-sectional area of the frac plug 200 or the hydraulic diameter of a flow path (or a combined flow area) through the frac plug 200. The "hydraulic diameter" is defined as four times the cross-sectional area divided by the wetted perimeter of the cross section. As illustrated, the frac plug 200 may exhibit an inner diameter 232 and an outer diameter 234. The inner diameter 232 may generally comprise the diameter of the central flow passage 210, and the outer diameter 234 may comprise the diameter of the frac plug 200 in the run-in or unexpanded configuration. In at least one embodiment, the inner diameter 232 of the frac plug 200 may be at least 17% (i.e., 1/6) of the outer diameter 234 of the frac plug 200. In another embodiment, the inner diameter 232 of the frac plug 200 may be at least 25% (i.e., 1/4) of the outer diameter 234 of the frac plug 200. The minimum 17% threshold may be calculated from the pressure drop across the frac plug 200 as a function of the flow rate through the central flow passage 210 in applications having multiple wellbore isolation devices positioned within the wellbore 106. Having the inner diameter 232 greater than 17% of the outer diameter 234 may increase the production flow area through the central flow passage 210 and thereby provide a lower pressure drop across the frac plug 200. The upper limit of the inner diameter 232 may be dependent on the structural limitations of the frac plug 200 and, more particularly, the structural limitations of the mandrel 206. For instance, the inner diameter 232 may be any diameter as long as the mandrel 206 remains able to adequately hold or maintain pressure loads that may be assumed during downhole operation.

In yet other embodiments, the minimum production flow area of the frac plug 200 may need to be larger than the aforementioned two options. With a larger number of wellbore isolation devices, with higher production flow rates, or with lower acceptable pressure drop, the minimum production flow area should be larger to achieve a lower pressure drop of the fluid across the frac plug 200. In these cases, the fraction of the total flow area should be larger, or the inner diameter 232 of the frac plug 200 should be a higher fraction of the outer diameter 234. For example, in at least one embodiment, a large number of wellbore isolation devices (e.g., greater than twenty-nine) may be required. In such embodiments, the minimum production flow area of the frac plug 200 may be achieved by having a production flow area through and/or around the frac plug 200 that is at least 1/9 of the total flow area of the wellbore 106 (i.e., the casing 114) at the location of the frac plug 200, or where the inner diameter 232 of the frac plug 200 is at least 33% (i.e., 1/3) of the outer diameter 234. In another embodiment, an even larger number of wellbore isolation devices (e.g., greater than forty-nine) may be required for a specific application. In such embodiments, the minimum production flow area of the frac plug 200 may be achieved by having a production flow area through and/or around the frac plug 200 that is at least 1/6 of the total flow area of the wellbore 106 at the location of the frac plug 200, or where the inner diameter 232 of the frac plug 200 is at least 41% of the outer diameter 234.

Figure 3:
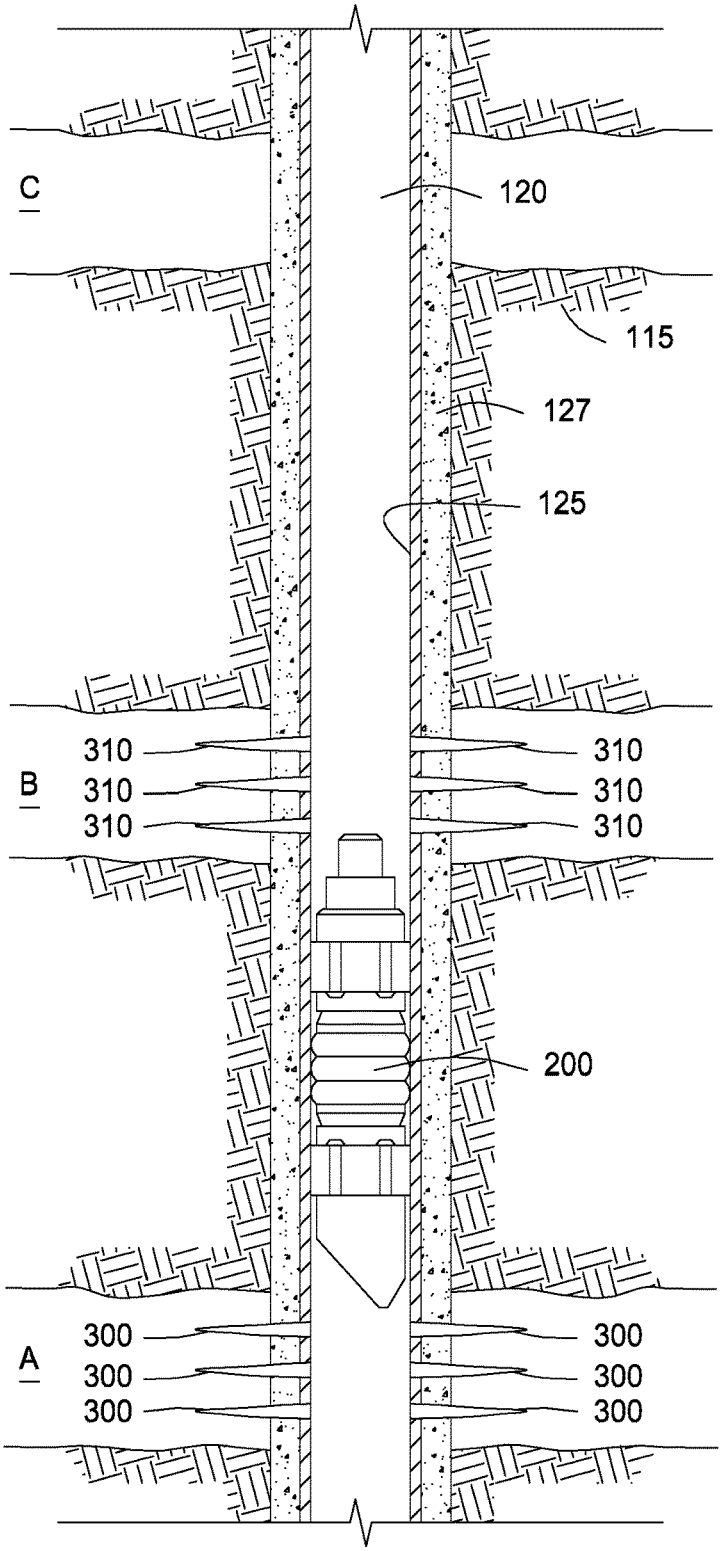
FIG. 3 is a cross-sectional view of a frac plug in operation, according to one or more embodiments of the present disclosure.

Referring now to FIG. 3, with continued reference to FIG. 2, the frac plug 200 is shown disposed between producing zone A and producing zone B in subterranean formation 115. In a conventional fracturing operation, before setting the frac plug 200 to isolate zone A from zone B, at least one, and in this example a plurality of perforations 300 are made by a perforating tool (not shown) through casing string 125 and cement 127 to extend into producing zone A. In those embodiments where casing string 125 and cement 127 is not disposed within the wellbore 120, the perforations 300 in Zone A (as well as those perforations 310 referenced below related to Zone B) are made directly into the formation 115 from the wellbore 125. Thereafter, a well stimulation fluid is introduced into the wellbore 120, such as by lowering a tool (not shown) into the wellbore 120 for discharging the stimulation fluid at a relatively high pressure or by pumping the fluid directly from the derrick 112 (FIG. 1) into the wellbore 120 above a fracture gradient of the formation 115. The well stimulation fluid passes through the perforations 300 into producing zone A of the formation 115 for stimulating the recovery of fluids in the form of oil and gas containing hydrocarbons. These production fluids pass from zone A, through the perforations 300, and up the wellbore 120 for recovery at the surface 104 (FIG. 1).

The frac plug 200 is then lowered by the tool string 118 (FIG. 1) to the desired depth within the wellbore 120, and the packer elements 220 (FIG. 2) are set against the casing string 125, thereby isolating zone A as depicted in FIG. 3 and "setting" the frac plug 200. Due to the design of the frac plug 200, the central flow passage 210 (FIG. 2) of the frac plug 200 allows fluid from isolated zone A to flow upwardly through the frac plug 200 while preventing flow downwardly into the isolated zone A. Accordingly, the production fluids from zone A continue to pass through the perforations 300, into the wellbore 120, and upwardly through the flowbore 205 of the frac plug 200, before flowing into the wellbore 120 above the frac plug 200 for recovery at the surface 104 (FIG. 1).

After the frac plug 200 is set into position, as shown in FIG. 3, a second set of perforations 310 may then be formed into the formation 115 through the casing string 125 and cement 127 adjacent intermediate producing zone B of the formation 115. Zone B is then treated with well stimulation fluid, causing the recovered fluids from zone B to pass through the perforations 310 into the wellbore 120. In this area of the wellbore 120 above the frac plug 200, the recovered fluids from zone B will mix with the recovered fluids from zone A before flowing upwardly within the wellbore 120 for recovery at the surface 104 (FIG. 1).

If additional fracturing operations will be performed, such as recovering hydrocarbons from zone C, additional frac plugs 200 may be installed within the wellbore 120 to isolate each zone within the formation 115. Each frac plug 200 allows fluid to flow upwardly therethrough from the lowermost zone A to the uppermost zone C of the formation 115, but pressurized fluid cannot flow downwardly through the frac plug 200.

After the fluid recovery operations are complete (i.e., "hydrocarbon production"), the frac plug 200 must be removed from the wellbore 120. In this context, as stated above, degradation of one or more components, including degradation of at least the slips and/or mandrel, at least a portion of which are composed of a degradable alloy, is begun or already in progress, such as due to exposure of the wellbore environment. For example, an electrolyte fluid may be used as the stimulation fluid or as a post-flush fluid to induce degradation of the degradable alloys to begin. Where another degradable component(s) is an oil-degradable material, such degradable component(s) may degrade as the produced hydrocarbon fluids flow past the frac plug 200 to the surface 104 (FIG. 1). In other embodiments, the mandrel 206 and/or slips 216*a,b*, or any other component a portion of which is composed of a degradable alloy, may degrade upon prolonged contact with electrolytic fluids present naturally in the wellbore 120. In some preferred embodiments, the mandrel 206 and/or the slips are composed of a degradable alloy. Other combinations of degradability are suitable, without departing from the scope of the present disclosure, as discussed above, for example.

In some embodiments, regardless of whether degradation of the component of the frac plug 200 or production of the hydrocarbons from the formation 115 occurs first, no wellbore intervention occurs between hydraulically fracturing the subterranean formation (i.e., introducing the stimulation fluid through the perforations 300 and/or 310) and degradation or production. As used herein, the term "wellbore intervention" refers to the introduction of a tool or conveyance within the wellbore 120 for only the purposes of removing a tool or debris in the wellbore. Such "wellbore intervention," accordingly, encompasses introduction of a tool or conveyance for removal of the frac plug 200 described herein or debris from the frac plug 200, such as due to one or more components or portions of the frac plug 200 degrading. As another example, a wellbore intervention may be a coiled tubing run, where coiled tubing is introduced and traverses some distance within the wellbore 120 for the purpose of removing a tool or debris. In another example, a wellbore intervention may be a mill run, where a milling bit is run into the wellbore 120 to mill out certain tools. In yet another example, a wellbore intervention may be use of a junk basket to remove debris. In the current disclosure, the term "wellbore intervention," therefore does not encompass introducing a tool necessary for production, such as a production packer. Accordingly, if degradation begins directly after hydraulic fracturing, no wellbore intervention occurs between hydraulic fracturing and the initiation of degradation; if production begins directly after hydraulic fracturing, no wellbore intervention occurs between hydraulic fracturing and the initiation of production. In yet other embodiments, regardless of whether degradation or production begins last, no wellbore intervention occurs between hydraulic fracturing and the last of either degradation beginning or production beginning. That is, no wellbore intervention may occur between hydraulic fracturing and degradation beginning, between hydraulic fracturing and production beginning, and/or between hydraulic fracturing and the both of degradation beginning and production beginning. In all instances, the lack of wellbore intervention may be merely a lack of wellbore intervention beyond the frac plug 200 or may be a lack of wellbore intervention in the wellbore as a whole (i.e., the entire length of the wellbore). Wellbore interventions are expensive, have the potential to become stuck in the wellbore, have the potential to damage the formation due to swabbing of associated fluids, and the like. Minimizing the number of wellbore interventions, as well as the size of the intervention tool, is thus important to maintaining the integrity of the wellbore and minimizing costs. For example, a smaller sized sand circulation tool poses less intervention issues than a larger diameter mill bit, which is a wellbore intervention avoidable due to the embodiments of the present disclosure.

The frac plug 200 is designed to decompose over time while operating in a wellbore environment, thereby eliminating the need to mill or drill the frac plug 200 out of the wellbore 120, whether such degradation begins before or after production of hydrocarbons therefrom. Degradation causes the frac plug 200 to lose structural and/or functional integrity and release from the casing 125 (or the wall of the wellbore 120). The remaining non-degradable or degrading components of the frac plug 200 will simply fall to the bottom of the wellbore 120. In various alternate embodiments, degrading one or more components of the frac plug 200 performs an actuation function, opens a passage, releases a retained member, or otherwise changes the operating mode of the frac plug 200, also eliminating any need to mill or drill the frac plug 200 from the wellbore 120. For example, as previously mentioned, at least a portion of the frac ball 208 may be composed of a degradable substance, including a degradable metal material and/or a degradable elastomer, such that upon degradation, the flow passage previously blocked by the frac ball 208 is opened. Also, as described below, the material or components embedded therein for forming degradable components of the frac plug 200 (e.g., at least the degradable mandrel 206 and/or slips 216*a,b*), as well as the use of an optional sheath, may be selected to control the degradation rate of such degradable components of the frac plug 200.

Removing the frac plug 200 described herein from the wellbore 120 is more cost effective and less time consuming than removing conventional frac plugs (or wellbore isolation devices), which require making one or more trips into the wellbore 120 with a mill or drill to gradually grind or cut the tool away. Instead, the wellbore isolation devices, and frac plugs, described herein are removable by simply upon exposure to a naturally occurring or synthetic (e.g., upon introduction of an external stimulus) downhole environment over time. The descriptions of specific embodiments of the frac plug 200, and the systems and methods for removing the frac plug 200 from the wellbore 120 described herein have been presented for purposes of illustration and description and are not intended to be exhaustive or to limit this disclosure to the precise forms disclosed. Many other modifications and variations are possible. In particular, the type of frac plug 200, or the particular components that make up the frac plug 200 (e.g., the mandrel, the slips, and the like) may be varied.

Referring again to FIG. 2, according to the present disclosure, at least a portion of the mandrel 206 and/or the slips 216*a,b* (without excluding other components) of the frac plug 200 may be made of or otherwise comprise a degradable metal material configured to degrade or dissolve within a wellbore environment. In other embodiments, other components of the frac plug 200 may also be made of or otherwise comprise a degradable metal material including, but not limited to, the frac ball 208, the upper and lower slips 216*a,b*, the upper and lower slip wedges 218*a,b*, and the mule shoe 222. In addition to the foregoing, other components of the frac plug 200 that may be made of or otherwise comprise a degradable metal material include, but are not limited to, extrusion limiters and shear pins associated with the frac plug 200. The foregoing structural elements or components of the frac plug 200 are collectively referred to herein as "the components" in the following discussion. In some embodiments, as discussed below, the frac ball 208 may be composed of a degradable metal material (e.g., a degradable magnesium and/or aluminum alloy), a degradable elastomer, a degradable glass material, and any combination thereof. In some embodiments, as discussed in greater detail below, the packer element 220 is composed of a non-degradable or minimally degradable elastomer, or a degradable elastomer. As used herein, the term "minimally degradable" refers to degradation of no more than about 50% by volume of the material in a wellbore environment.

The degradable materials (e.g., a degradable metal material, a degradable elastomer, and/or a degradable glass material, and the like) for forming at least a portion of a component of a frac plug 200 in accordance with the methods described herein may be collectively referred to simply as "degradable substances." These degradable substances degrade, at least in part, in the presence of an aqueous fluid (e.g., a treatment fluid), a hydrocarbon fluid (e.g., a produced fluid in the formation or a treatment fluid), an elevated temperature, and any combination thereof. That is, the degradable substances may wholly degrade or partially degrade. The aqueous fluid that may degrade the degradable substances may include, but is not limited to, fresh water, saltwater (e.g., water containing one or more salts dissolved therein), brine (e.g., saturated salt water), seawater, or combinations thereof. Accordingly, the aqueous fluid may comprise ionic salts, which form an electrolyte aqueous solution particularly suitable for degradation of the degradable metal material, for example, and as discussed in greater detail below. The aqueous fluid may come from the wellbore 106 itself (i.e., the subterranean formation) or may be introduced by a wellbore operator. The hydrocarbon fluid may include, but is not limited to, crude oil, a fractional distillate of crude oil, a fatty derivative of an acid, an ester, an ether, an alcohol, an amine, an amide, or an imide, a saturated hydrocarbon, an unsaturated hydrocarbon, a branched hydrocarbon, a cyclic hydrocarbon, and any combination thereof. The elevated temperature may be above the glass transition temperature of the degradable substance, such as when the degradable elastomer is a thiol-based polymer, or may be a temperature greater than about 60° C. (140° F.).

The degradable substances forming at least a portion of the frac plug 200 may degrade by a number of mechanisms. For example, the degradable substances may degrade by galvanic corrosion, swelling, dissolving, undergoing a chemical change, undergoing thermal degradation in combination with any of the foregoing, and any combination thereof. Degradation by galvanic corrosions refers to corrosion occurring when two different metals or metal alloys are in electrical connectivity with each other and both are in contact with an electrolyte, and include microgalvanic corrosion. As used herein, the term "electrical connectivity" means that the two different metals or metal alloys are either touching or in close proximity to each other such that when contacted with an electrolyte, the electrolyte becomes electrically conductive and ion migration occurs between one of the metals and the other metal. When the degradable substance is a degradable metal material, the degradable metal material degrades by galvanic corrosion.

Degradation by swell involves the absorption by the degradable substance of a fluid in the wellbore environment such that the mechanical properties of the degradable substance degrade. That is, the degradable substance continues to absorb the fluid until its mechanical properties are no longer capable of maintaining the integrity of the degradable substance and it at least partially falls apart. In some embodiments, a degradable substance may be designed to only partially degrade by swelling in order to ensure that the mechanical properties of the component of the frac plug 200 formed from the degradable substance is sufficiently capable of lasting for the duration of the specific operation in which it is utilized. Degradation by dissolving involves use of a degradable substance that is soluble or otherwise susceptible to a fluid in the wellbore environment (e.g., an aqueous fluid or a hydrocarbon fluid), such that the fluid is not necessarily incorporated into the degradable substance (as is the case with degradation by swelling), but becomes soluble upon contact with the fluid. Degradation by undergoing a chemical change may involve breaking the bonds of the backbone of the degradable substance (e.g., polymer backbone) or causing the bonds of the degradable substance to crosslink, such that the degradable substance becomes brittle and breaks into small pieces upon contact with even small forces expected in the wellbore environment. Thermal degradation involves a chemical decomposition due to heat, such as the heat present in a wellbore environment. Thermal degradation of some degradable substances described herein may occur at wellbore environment temperatures of greater than about 93° C. (or about 200° F.), or greater than about 50° C. (or about 122° F.). Each degradation method may work in concert with one or more of the other degradation methods, without departing from the scope of the present disclosure.

Referring now to the degradable metal materials of the present disclosure, the term "degradable metal material" (also referred to simply as "degradable metal" herein) may refer to the rate of dissolution of the degradable metal material, and the rate of dissolution may correspond to a rate of material loss at a particular temperature and within a particular wellbore environment, such as in the presence of an electrolyte. In at least one embodiment, the degradable metal materials described herein exhibit an average degradation rate in an amount of greater than about 0.01 milligrams per square centimeters ($mg/cm^2$) per hour at 93° C. (equivalent to about 200° F.) while exposed to a 15% potassium chloride (KCl) solution. For example, in some embodiments, the degradable metal materials may have an average degradation rate of greater than in the range of from about 0.01 $mg/cm^2$ to about 10 $mg/cm^2$ per hour at a temperature of about 93° C. while exposed to a 15% KCl solution, encompassing any value and subset therebetween. For example, the degradation rate may be about 0.01 $mg/cm^2$ to about 2.5 $mg/cm^2$, or about 2.5 $mg/cm^2$ to about 5 $mg/cm^2$, or about 5 $mg/cm^2$ to about 7.5 $mg/cm^2$, or about 7.5 $mg/cm^2$ to about 10 $mg/cm^2$ per hour at a temperature of 93° C. while exposed to a 15% KCl solution, encompassing any value and subset therebetween.

In other instances, the degradable metal material may exhibit a degradation rate such that it loses greater than about 0.1% of its total mass per day at 93° C. in a 15% KCl solution. For example, in some embodiments, the degradable metal materials described herein may have a degradation rate such that it loses about 0.1% to about 10% of its total mass per day at 93° C. in a 15% KCl solution, encompassing any value and subset therebetween. For example, in some embodiments the degradable metal material may lose about 0.1% to about 2.5%, or about 2.5% to about 5%, or about 5% to about 7.5%, or about 7.5% to about 10% of its total mass per day at 93° C. in a 15% KCl solution, encompassing any value and subset therebetween. Each of these values representing the degradable metal material is critical to the embodiments of the present disclosure and may depend on a number of factors including, but not limited to, the type of degradable metal material, the wellbore environment, and the like.

It should be noted that the various degradation rates noted in a 15% KCl solution are merely a means of defining the degradation rate of the degradable metal materials described herein by reference to contact with a specific electrolyte at a specific temperature. The use of the wellbore isolation device 200 having a degradable metal material may be exposed to other wellbore environments to initiate degradation, without departing from the scope of the present disclosure.

It should be further noted, that the non-metal degradable materials also discussed herein, which may be used for forming components of the frac plug 200 may additionally have a degradation rate in the same amount or range as that of the degradable metal material, which may allow use of certain degradable materials that degrade at a rate faster or slower than other degradable materials (including the degradable metal materials) for forming the frac plug 200.

The degradation of the degradable metal material may be in the range of from about 5 days to about 40 days, encompassing any value or subset therebetween. For example, the degradation may be about 5 days to about 10 days, or about 10 days to about 20 days, or about 20 days to about 30 days, or about 30 days to about 40 days, encompassing any value and subset therebetween. Each of these values representing the degradable metal material is critical to the embodiments of the present disclosure and may depend on a number of factors including, but not limited to, the type of degradable metal material, the wellbore environment, and the like.

Suitable degradable metal materials that may be used in accordance with the embodiments of the present disclosure include galvanically-corrodible or degradable metals and metal alloys. Such metals and metal alloys may be configured to degrade via galvanic corrosion in the presence of an electrolyte (e.g., brine or other salt-containing fluids present within the wellbore 106). As used herein, an "electrolyte" is any substance containing free ions (i.e., a positively or negatively charged atom or group of atoms) that make the substance electrically conductive. The electrolyte can be selected from the group consisting of, solutions of an acid, a base, a salt, and combinations thereof.

Electrolytes may include, but are not limited to, a halide anion (i.e., fluoride, chloride, bromide, iodide, and astatide), a halide salt, an oxoanion (including monomeric oxoanions and polyoxoanions), and any combination thereof. Suitable examples of halide salts for use as the electrolytes of the present disclosure may include, but are not limited to, a potassium fluoride, a potassium chloride, a potassium bromide, a potassium iodide, a sodium chloride, a sodium bromide, a sodium iodide, a sodium fluoride, a calcium fluoride, a calcium chloride, a calcium bromide, a calcium iodide, a zinc fluoride, a zinc chloride, a zinc bromide, a zinc iodide, an ammonium fluoride, an ammonium chloride, an ammonium bromide, an ammonium iodide, a magnesium chloride, potassium carbonate, potassium nitrate, sodium nitrate, and any combination thereof. The oxyanions for use as the electrolyte of the present disclosure may be generally represented by the formula $A_xO_y^{z-}$, where A represents a chemical element and O is an oxygen atom; x, y, and z are integers between the range of about 1 to about 30, and may be or may not be the same integer. Examples of suitable oxoanions may include, but are not limited to, carbonate (e.g., hydrogen carbonate ($HCO_3^-$)), borate, nitrate, phosphate (e.g., hydrogen phosphate ($HPO_4^{2-}$)), sulfate, nitrite, chlorite, hypochlorite, phosphite, sulfite, hypophosphite, hyposulfite, triphosphate, and any combination thereof. Other common free ions that may be present in an electrolyte may include, but are not limited to, sodium ($Na^+$), potassium ($K^+$), calcium ($Ca^{2+}$), magnesium ($Mg^{2+}$), and any combination thereof. Preferably, the electrolyte contains chloride ions. The electrolyte can be a fluid that is introduced into the wellbore 106 or a fluid emanating from the wellbore 106, such as from a surrounding subterranean formation (e.g., the formation 108 of FIG. 1).

In some embodiments, the electrolyte may be present in an aqueous base fluid up to saturation for contacting the degradable metal material components of the frac plug 200, which may vary depending on the type of degradable metal material, the aqueous base fluid selected, and the like, and any combination thereof. In other embodiments, the electrolyte may be present in the aqueous base fluid in the range of from about 0.001% to about 30% by weight of the aqueous base fluid, encompassing any value and subset therebetween. For example, the electrolyte may be present of from about 0.001% to about 0.01%, or about 0.01% to about 1%, or about 1% to about 6%, or about 6% to about 12%, or about 12% to about 18%, or about 18% to about 24%, or about 24% to about 30% by weight of the aqueous base fluid. Each of these values is critical to the embodiments of the present disclosure and may depend on a number of factors including, but not limited to, the composition of the degradable metal material, the components of the wellbore isolation device composed of the degradable metal material, the type of electrolyte selected, other conditions of the wellbore environment, and the like.

The degradable metal materials for use in forming at least the mandrel 206 and/or slips 216*a,b* of the frac plug 200 for use in implementing the methods described herein may include a metal material that is galvanically corrodible in a wellbore environment, such as in the presence of an electrolyte, as previously discussed. Suitable such degradable metal materials may include, but are not limited to, gold, gold-platinum alloys, silver, nickel, nickel-copper alloys, nickel-chromium alloys, copper, copper alloys (e.g., brass, bronze, etc.), chromium, tin, tin alloys (e.g., pewter, solder, etc.), aluminum, aluminum alloys (e.g., silumin alloy, a magnalium alloy, etc.), iron, iron alloys (e.g., cast iron, pig iron, etc.), zinc, zinc alloys (e.g., zamak, etc.), magnesium, magnesium alloys (e.g., elektron, magnox, etc.), beryllium, beryllium alloys (e.g., beryllium-copper alloys, beryllium-nickel alloys), and any combination thereof.

Suitable magnesium alloys include alloys having magnesium at a concentration in the range of from about 60% to about 99.95% by weight of the magnesium alloy, encompassing any value and subset therebetween. In some embodiments, the magnesium concentration may be in the range of about 60% to about 99.95%, 70% to about 98%, and preferably about 80% to about 95% by weight of the magnesium alloy, encompassing any value and subset therebetween. Each of these values is critical to the embodiments of the present disclosure and may depend on a number of factors including, but not limited to, the type of magnesium alloy, the desired degradability of the magnesium alloy, and the like.

Magnesium alloys comprise at least one other ingredient besides the magnesium. The other ingredients can be selected from one or more metals, one or more non-metals, or a combination thereof. Suitable metals that may be alloyed with magnesium include, but are not limited to, lithium, sodium, potassium, rubidium, cesium, beryllium, calcium, strontium, barium, aluminum, gallium, indium, tin, thallium, lead, bismuth, scandium, titanium, vanadium, chromium, manganese, iron, cobalt, nickel, copper, zinc, yttrium, zirconium, niobium, molybdenum, ruthenium, rhodium, palladium, praseodymium, silver, lanthanum, hafnium, tantalum, tungsten, terbium, rhenium, osmium, iridium, platinum, gold, neodymium, gadolinium, erbium, oxides of any of the foregoing, and any combinations thereof.

Suitable non-metals that may be alloyed with magnesium include, but are not limited to, graphite, carbon, silicon, boron nitride, and combinations thereof. The carbon can be in the form of carbon particles, fibers, nanotubes, fullerenes, and any combination thereof. The graphite can be in the form of particles, fibers, graphene, and any combination thereof. The magnesium and its alloyed ingredient(s) may be in a solid solution and not in a partial solution or a compound where inter-granular inclusions may be present. In some embodiments, the magnesium and its alloyed ingredient(s) may be uniformly distributed throughout the magnesium alloy but, as will be appreciated, some minor variations in the distribution of particles of the magnesium and its alloyed ingredient(s) can occur. In other embodiments, the magnesium alloy is a sintered construction.

In some embodiments, the magnesium alloy may have a yield stress in the range of from about 20000 pounds per square inch (psi) to about 50000 psi, encompassing any value and subset therebetween. For example, in some embodiments, the magnesium alloy may have a yield stress of about 20000 psi to about 30000 psi, or about 30000 psi to about 40000 psi, or about 40000 psi to about 50000 psi, encompassing any value and subset therebetween. Each of these values is critical to the embodiments of the present disclosure and may depend on a number of factors including, but not limited to, the component of the frac plug 200 formed from the degradable magnesium alloy, the composition of the degradable magnesium alloy selected, and the like, and any combination thereof.

Suitable aluminum alloys include alloys having aluminum at a concentration in the range of from about 40% to about 99% by weight of the aluminum alloy, encompassing any value and subset therebetween. For example, suitable magnesium alloys may have aluminum concentrations of about 40% to about 50%, or about 50% to about 60%, about 60% to about 70%, or about 70% to about 80%, or about 80% to about 90%, or about 90% to about 99% by weight of the aluminum alloy, encompassing any value and subset therebetween. Each of these values is critical to the embodiments of the present disclosure and may depend on a number of factors including, but not limited to, the type of aluminum alloy, the desired degradability of the aluminum alloy, and the like.

The aluminum alloys may be wrought or cast aluminum alloys and comprise at least one other ingredient besides the aluminum. The other ingredients can be selected from one or more any of the metals, non-metals, and combinations thereof described above with reference to magnesium alloys, with the addition of the aluminum alloys additionally being able to comprise magnesium.

In some embodiments, the degradable metal materials may be a degradable metal alloy, which may exhibit a nano-structured matrix form and/or inter-granular inclusions (e.g., a magnesium alloy with iron-coated inclusions). Such degradable metal alloys may further include a dopant, where the presence of the dopant and/or the inter-granular inclusions increases the degradation rate of the degradable metal alloy. Other degradable metal materials include solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which cause micro-galvanic corrosion and degradation. Another example of a solution-structured galvanically-corrodible material is a ZK60 magnesium alloy, which includes 4.5% to 6.5% zinc, minimum 0.25% zirconium, 0% to 1% other, and balance magnesium; AZ80, which includes 7.5% to 9.5% aluminum, 0.2% to 0.8% zinc, 0.12% manganese, 0.015% other, and balance magnesium; and AZ31, which includes 2.5% to 3.5% aluminum, 0.5% to 1.5% zinc, 0.2% manganese, 0.15% other, and the balance magnesium. Each of these examples is % by weight of the metal alloy. In some embodiments, "other" may include unknown materials, impurities, additives, and any combination thereof.

The degradable metal magnesium alloys may be solution structured with other elements such as zinc, aluminum, nickel, iron, carbon, tin, silver, copper, titanium, rare earth elements, and the like, and any combination thereof. Degradable metal aluminum alloys may be solution structured with elements such as nickel, iron, carbon, tin, silver, copper, titanium, gallium, and the like, and any combination thereof.

In some embodiments, an alloy, such as a magnesium alloy or an aluminum alloy described herein has a dopant included therewith, such as during fabrication. For example, the dopant may be added to one of the alloying elements prior to mixing all of the other elements in the alloy. For example, during the fabrication of an AZ aluminum alloy, the dopant (e.g., zinc) may be dissolved in aluminum, followed by mixing with the remaining alloy, magnesium, and other components if present. Additional amounts of the aluminum may be added after dissolving the dopant, as well, without departing from the scope of the present disclosure, in order to achieve the desired composition. Suitable dopants for inclusion in the degradable metal alloy materials described herein may include, but are not limited to, iron, copper, nickel, gallium, carbon, tungsten, silver, and any combination thereof.

The dopant may be included with the magnesium and/or aluminum alloy degradable metal materials described herein in an amount of from about 0.05% to about 15% by weight of the degradable metal material, encompassing every value and subset therebetween. For example, the dopant may be present in an amount of from about 0.05% to about 3%, or about 3% to about 6%, or about 6% to about 9%, or about 9% to about 12%, or about 12% to about 15% by weight of the degradable metal material, encompassing every value and subset therebetween. Other examples include a dopant in an amount of from about 1% to about 10% by weight of the degradable metal material, encompassing every value and subset therebetween. Each of these values is critical to the embodiments of the present disclosure and may depend on a number of factors including, but not limited to, the type of magnesium and/or aluminum alloy selected, the desired rate of degradation, the wellbore environment, and the like, and any combination thereof.

As specific examples, the magnesium alloy degradable metal material may comprise a nickel dopant in the range of about 0.1% to about 6% (e.g., about 0.1%, about 0.5%, about 1%, about 2%, about 3%, about 4%, about 5%, about 6%) by weight of the alloy, encompassing any value and subset therebetween; a copper dopant in the range of about 6% to about 12% (e.g., about 6%, about 7%, about 8%, about 9%, about 10%, about 11%, about 12%) by weight of the alloy, encompassing any value and subset therebetween; and/or an iron dopant in the range of about 2% to about 6% (e.g., about 2%, about 3%, about 4%, about 5%, about 6%) by weight of the alloy, encompassing any value and subset therebetween. As described above, each of these values is critical to the embodiments of the present disclosure to at least affect the degradation rate of the magnesium alloy.

As specific examples, the aluminum alloy degradable metal material may comprise a copper dopant in the range of about 8% to about 15% (e.g., about 8%, about 9%, about 10%, about 11%, about 12%, about 13%, about 14%, about 15%) by weight of the alloy, encompassing any value and subset therebetween; a mercury dopant in the range of about 0.2% to about 4% (e.g., about 0.2%, about 0.5%, about 1%, about 2%, about 3%, about 4%) by weight of the alloy, encompassing any value and subset therebetween; a nickel dopant in the range of about 1% to about % (e.g., about 1%, about 2%, about 3%, about 4%, about 5%, about 6%, about 7%) by weight of the alloy, encompassing any value and subset therebetween; a gallium dopant in the range of about 0.2% to about 4% (e.g., about 0.2%, about 0.5%, about 1%, about 2%, about 3%, about 4%) by weight of the alloy, encompassing any value and subset therebetween; and/or an iron dopant in the range of about 2% to about 7% (e.g., about 2%, about 3%, about 4%, about 5%, about 6%, about 7%) by weight of the alloy, encompassing any value and subset therebetween. As described above, each of these values is critical to the embodiments of the present disclosure to at least affect the degradation rate of the aluminum alloy.

The degradable metal materials (e.g., magnesium and/or aluminum alloys) described herein may further comprise an amount of material, termed "supplementary material," that is defined as neither the primary alloy, other specific alloying materials forming the doped alloy, or the dopant. This supplementary material may include, but is not limited to, unknown materials, impurities, additives (e.g., those purposefully included to aid in mechanical properties), and any combination thereof. The supplementary material minimally, if at all, effects the acceleration of the corrosion rate of the doped alloy. Accordingly, the supplementary material may, for example, inhibit the corrosion rate or have no affect thereon. As defined herein, the term "minimally" with reference to the effect of the acceleration rate refers to an effect of no more than about 5% as compared to no supplementary material being present. This supplementary material may enter the degradable metal materials of the present disclosure due to natural carry-over from raw materials, oxidation of the degradable metal material or other elements, manufacturing processes (e.g., smelting processes, casting processes, alloying process, and the like), or the like, and any combination thereof. Alternatively, the supplementary material may be intentionally included additives placed in the degradable metal material to impart a beneficial quality thereto, such as a reinforcing agent, a corrosion retarder, a corrosion accelerant, a reinforcing agent (i.e., to increase strength or stiffness, including, but not limited to, a fiber, a particulate, a fiber weave, and the like, and combinations thereof), silicon, calcium, lithium, manganese, tin, lead, thorium, zirconium, beryllium, cerium, praseodymium, yttrium, and the like, and any combination thereof. Generally, the supplemental material is present in the degradable metal material described herein in an amount of less than about 10% by weight of the degradable metal material, including no supplemental material at all (i.e., 0%).

Examples of specific magnesium alloy degradable metal materials for use in the embodiments of the present disclosure may include, but are not limited to, a doped MG magnesium alloy, a doped WE magnesium alloy, a doped AZ magnesium alloy, a doped AM magnesium alloy, or a doped ZK magnesium alloy. As defined herein, a "doped MG magnesium alloy" is an alloy comprising at least magnesium, dopant, and optional supplemental material, as defined herein; a "doped WE magnesium alloy" is an alloy comprising at least a rare earth metal, magnesium, dopant, and optional supplemental material, as defined herein; a "doped AZ magnesium alloy" is an alloy comprising at least aluminum, zinc, magnesium, dopant, and optional supplemental material, as defined herein; a "doped AM magnesium" is an alloy comprising at least aluminum, manganese, magnesium, dopant, and optional supplemental material, as defined herein; and a "ZK magnesium alloy" is an alloy comprising at least zinc, zirconium, magnesium, dopant, and optional supplemental material, as defined herein.

The doped MG magnesium alloy comprises about 75% to about 99.95% of magnesium, about 0.05% to about 15% of dopant, and about 0% to about 10% of supplemental material, each by weight of the doped MG magnesium alloy. The doped WE magnesium alloy comprises about 60% to about 98.95% of magnesium, about 1% to about 15% of a rare earth metal or combination of rare earth metals, about 0.05% to about 15% of dopant, and about 0% to about 10% of supplemental material, each by weight of the doped WE magnesium alloy. The rare earth metal may be selected from the group consisting of scandium, lanthanum, cerium, praseodymium, neodymium, promethium, samarium, europium, gadolinium, dysprosium, holmium, erbium, thulium, ytterbium, lutetium, yttrium, and any combination thereof. The doped AZ magnesium alloy comprises about 57.3% to about 98.85% of magnesium, about 1% to about 12.7% of aluminum, about 0.05% to about 15% of dopant, and about 0% to about 10% of supplemental material, each by weight of the doped AZ magnesium alloy. The doped ZK magnesium alloy comprises about 58% to about 98.94% of magnesium, about 1% to about 12% of zinc, about 0.01% to about 5% of zirconium, about 0.05% to about 15% of dopant, and about 0% to about 10% of supplemental material, each by weight of the doped ZK magnesium alloy. The doped AM magnesium alloy comprises about 61% to about 97.85% of magnesium, about 2% to about 10% of aluminum, about 0.1% to about 4% of manganese, about 0.05% to about 15% of dopant, and about 0% to about 10% of supplemental material, each by weight of the doped AM magnesium alloy. Each of these values is critical to the embodiments of the present disclosure and may depend on a number of factors including, but not limited to, the desired degradation rate, the type of dopant(s) selected, the presence and type of supplemental material, and the like, and combinations thereof.

Examples of specific aluminum alloy degradable metal materials for use in the embodiments of the present disclosure may include, but are not limited to, a doped silumin aluminum alloy (also referred to simply as "a doped silumin alloy"), a doped Al—Mg aluminum alloy, a doped Al—Mg—Mn aluminum alloy, a doped Al—Cu aluminum alloy, a doped Al—Cu—Mg aluminum alloy, a doped Al—Cu—Mn—Si aluminum alloy, a doped Al—Cu—Mn—Mg aluminum alloy, a doped Al—Cu—Mg—Si—Mn aluminum alloy, a doped Al—Zn aluminum alloy, a doped Al—Cu—Zn aluminum alloy, and any combination thereof. As defined herein, a "doped silumin aluminum alloy" is an alloy comprising at least silicon, aluminum, dopant, and optional supplemental material, as defined herein; a "doped Al—Mg aluminum alloy" is at alloy comprising at least magnesium, aluminum, dopant, and optional supplemental material, as defined herein; a "doped Al—Mg—Mn aluminum alloy" is an alloy comprising at least magnesium, manganese, aluminum, dopant, and optional supplemental material, as defined herein; a "doped Al—Cu aluminum alloy" is an alloy comprising at least copper, aluminum, dopant, and optional supplemental material, as defined herein; a "doped Al—Cu—Mg aluminum alloy" is an alloy comprising at least copper, magnesium, aluminum, dopant, and optional supplemental material, as defined herein; a "doped Al—Cu—Mn—Si aluminum alloy" is an alloy comprising at least copper, manganese, silicon, aluminum, dopant, and optional supplemental material, as defined herein; a "doped Al—Cu—Mn—Mg aluminum alloy" is an alloy comprising at least copper, manganese, magnesium, aluminum, dopant, and optional supplemental material, as defined herein; a "doped Al—Cu—Mg—Si—Mn aluminum alloy" is an alloy comprising at least copper, magnesium, silicon, manganese, aluminum, dopant, and optional supplemental material, as defined herein; a "doped Al—Zn aluminum alloy" is an alloy comprising at least zinc, aluminum, dopant, and optional supplemental material, as defined herein; and a "doped Al—Cu—Zn aluminum alloy" is an alloy comprising at least copper, zinc, aluminum, dopant, and optional supplemental material, as defined herein.

The doped silumin aluminum alloy comprises about 62% to about 96.95% of aluminum, about 3% to about 13% silicon, about 0.05% to about 15% of dopant, and about 0% to about 10% of supplemental material, each by weight of the doped silumin aluminum alloy. The doped Al—Mg aluminum alloy comprises about 62% to about 99.45% of aluminum, about 0.5% to about 13% of magnesium, about 0.05% to about 15% of dopant, and about 0% to about 10% of supplemental material, each by weight of the doped Al—Mg aluminum alloy. The doped Al—Mg—Mn aluminum alloy comprises about 67 to about 99.2% of aluminum, about 0.5% to about 7% of magnesium, about 0.25% to about 1% of manganese, about 0.05% to about 15% of dopant, and about 0% to about 10% of supplemental material, each by weight of the doped Al—Mg—Mn aluminum alloy. The doped Al—Cu aluminum alloy comprises about 64% to about 99.85% of aluminum, about 0.1% to about 11% of copper, about 0.05% to about 15% of dopant, and about 0% to about 10% of supplemental material, each by weight of the doped Al—Cu aluminum alloy.

The doped Al—Cu—Mg aluminum alloy comprises about 61% to about 99.6% of aluminum, about 0.1% to about 13% of copper, about 0.25% to about 1% of magnesium, about 0.05% to about 15% of dopant, and about 0% to about 10% of supplemental material, each by weight of the doped Al—Cu—Mg aluminum alloy. The doped Al—Cu—Mn—Si aluminum alloy comprises about 68.25% to about 99.35% of aluminum, about 0.1% to about 5% of copper, about 0.25% to about 1% of manganese, about 0.25% to about 0.75% of silicon, about 0.05% to about 15% of dopant, and about 0% to about 10% of supplemental material, each by weight of the doped Al—Cu—Mn—Si aluminum alloy.

The doped Al—Cu—Mn—Mg aluminum alloy comprises about 70.5% to about 99.35% of aluminum, about 0.1% to about 3% of copper, about 0.25% to about 0.75% of manganese, about 0.25% to about 0.75% of magnesium, about 0.05% to about 15% of dopant, and about 0% to about 10% of supplemental material, each by weight of the doped Al—Cu—Mn—Mg aluminum alloy. The doped Al—Cu—Mg—Si—Mn aluminum alloy comprises about 67.5% to about 99.49% of aluminum, about 0.5% to about 5% of copper, about 0.25% to about 2% of magnesium, about 0.1% to about 0.4% of silicon, about 0.01% to about 0.1% of manganese, about 0.05% to about 15% of dopant, and about 0% to about 10% of supplemental material, each by weight of the doped Al—Cu—Mg—Si—Mn aluminum alloy. The doped Al—Zn aluminum alloy comprises about 45% to about 84.95% of aluminum, about 15% to about 30% of zinc, about 0.05% to about 15% of dopant, and about 0% to about 10% of supplemental material, each by weight of the doped Al—Zn aluminum alloy. The doped Al—Cu—Zn aluminum alloy comprises about 63% to about 99.75% of aluminum, about 0.1% to about 10% of copper, about 0.1% to about 2$ of zinc, about 0.05% to about 15% of dopant, and about 0% to about 10% of supplemental material, each by weight of the doped Al—Cu—Zn aluminum alloy.

In some embodiments, where at least two components of the frac plug 200 are formed from a degradable metal material (e.g., a degradable magnesium and/or aluminum alloy), each component may comprise dissimilar metals that generate a galvanic coupling that either accelerates or decelerates the degradation rate of another component of the frac plug 200 that is at least partially composed of a degradable substance, whether a degradable metal material or a degradable non-metal material (e.g., a degradable elastomer), such as the packer element 220. As will be appreciated, such embodiments may depend on where the dissimilar metals lie on the galvanic series. In at least one embodiment, a galvanic coupling may be generated by embedding or attaching a cathodic substance or piece of material into an anodic component. For instance, the galvanic coupling may be generated by dissolving aluminum in gallium. A galvanic coupling may also be generated by using a sacrificial anode coupled to the degradable metal material. In such embodiments, the degradation rate of the degradable metal material may be decelerated until the sacrificial anode is dissolved or otherwise corroded away. As an example, the mandrel 206 and the slips 216*a,b* may both be composed of a degradable metal material, and the mandrel 206 may be a more electronegative material than the slips 216*a,b*. In such an embodiment, the galvanic coupling between the mandrel 206 and the slips 216*a,b* may cause the mandrel 206 to act as an anode and degrade before the slips 216*a,b*. Once the mandrel 206 has degraded, the slips 216*a,b* would dissolve or degrade independently.

In some embodiments, the density of the component of the frac plug 200 composed of a degradable metal material (e.g., at least the mandrel 206 and/or the slips 216*a,b*), as described herein, may exhibit a density that is relatively low. The low density may prove advantageous in ensuring that the frac plug 200 may can be placed in extended-reach wellbores, such as extended-reach lateral wellbores. As will be appreciated, the more components of the wellbore isolation device composed of a degradable metal material (or other material) having a low density, the lesser the density of the frac plug 200 as a whole. In some embodiments, the degradable metal material is a magnesium alloy or an aluminum alloy and may have a density of less than 3 g/cm$^3$, or less than 2 g/cm$^3$, or less than 1 g/cm$^3$, or even less. In other embodiments where the degradable metal material is a material that is lighter than steel, the density of the may be less than 5 g/cm$^3$, or less than 4 g/cm$^3$, or less than 3 g/cm$^3$, or less than 2 g/cm$^3$, or less than 1 g/cm$^3$, or even less. By way of example, the inclusion of lithium in a magnesium alloy can reduce the density of the alloy.

In some embodiments, the packer element 220 of the frac plug 200 may be composed of an elastomer that is sufficiently resilient (i.e., elastic) to provide a fluid seal between two portions of a wellbore section. In a preferred embodiment, the packer element 220 and/or a component of the slips 216*a,b*, such as one or more slip bands (i.e., for retaining the slips 216*a,b* against the mandrel 206 before the frac plug 200 is set), are composed of a degradable elastomer. It may be desirable that the amount of degradation is capable of causing the packer element 220 to no longer maintain a fluid seal in the wellbore capable of maintaining differential pressure. However, because the mandrel 206 and/or the slips 216*a,b* are additionally composed of a degradable substance, the degradation of at least the three components may not necessitate that the packer element 220 degrade to the point of breaking the fluid seal on its own. Similarly, it may be desirable that the frac plug 200 is composed of a degradable elastomer (or a degradable metal material as discussed above) and, in some cases, degradation of the frac plug 200 may be desirably faster in rate than any other degradable components, such that fluid flow is restored in the wellbore even before further degradation resulting in a loss of structural integrity of the frac plug 200 to be maintained at a particular location within the wellbore.

The degradation rate of the degradable elastomer may be accelerated, rapid, or normal, as defined herein. Accelerated degradation may be in the range of from about 2 hours to about 36 hours, encompassing any value or subset therebetween. Rapid degradation may be in the range of from about 36 hours to about 14 days, encompassing any value or subset therebetween. Normal degradation may be in the range of from about 14 days to about 120 days, encompassing any value or subset therebetween. Accordingly, the degradation may be between about 120 minutes to about 120 days. For example, the degradation of the degradable elastomer may be about 2 hours to about 30 days, or about 30 days to about 60 days, or about 60 days to about 90 days, or about 90 days to about 120 days, encompassing any value and subset therebetween. Each of these values is critical and depending on a number of factors including, but not limited to, the type of degradable elastomer selected, the conditions of the wellbore environment, and the like.

The degradable elastomer forming at least a portion of a component of the frac plug 200 (e.g., the packer element 220) may be a material that is at least partially degradable in a wellbore environment including, but not limited to, a polyurethane rubber (e.g., cast polyurethanes, thermoplastic polyurethanes, polyethane polyurethanes); a polyester-based polyurethane rubber (e.g., lactone polyester-based thermoplastic polyurethanes); a polyether-based polyurethane rubber; a thiol-based polymer (e.g., 1,3,5,-triacryloylhexahydro-1,3,5-triazine); a thiol-epoxy polymer (e.g., having an epoxide functional group, such as bisphenol-A diglycidyl ether, triglycidylisocyanurate, and/or trimethylolpropane triglycidyl ether); a hyaluronic acid rubber; a polyhydroxybutyrate rubber; a polyester elastomer; a polyester amide elastomer; a starch-based resin (e.g., starch-poly(ethylene-co-vinyl alcohol), a starch-polyvinyl alcohol, a starch-polylactic acid, starch-polycaprolactone, starch-poly(butylene succinate), and the like); a polyethylene terephthalate polymer; a polyester thermoplastic (e.g., polyether/ester copolymers, polyester/ester copolymers); a polylactic acid polymer; a polybutylene succinate polymer; a polyhydroxy alkanoic acid polymer; a polybutylene terephthalate polymer; a polysaccharide; chitin; chitosan; a protein; an aliphatic polyester; poly(ε-caprolactone); a poly(hydroxybutyrate); poly(ethyleneoxide); poly(phenyllactide); a poly (amino acid); a poly(orthoester); polyphosphazene; a polylactide; a polyglycolide; a poly(anhydride) (e.g., poly (adipic anhydride), poly(suberic anhydride), poly(sebacic anhydride), poly(dodecanedioic anhydride), poly(maleic anhydride), and poly(benzoic anhydride), and the like); a polyepichlorohydrin; a copolymer of ethylene oxide/polyepichlorohydrin; a terpolymer of epichlorohydrin/ethylene oxide/allyl glycidyl ether; copolymers thereof; terpolymers thereof; and any combination thereof.

In some embodiments, the degradable elastomer selected may be a polyurethane rubber, a polyester-based polyurethane rubber, or a polyether-based polyurethane rubber (collectively simply "polyurethane-based rubbers). These polyurethane-based rubbers degrade in water through a hydrolytic reaction, although other degradation methods may also affect the degradability of the polyurethane-based rubbers. As used herein, the term "hydrolytic reaction," and variants thereof (e.g., "hydrolytic degradation") refers to the degradation of a material by cleavage of chemical bonds in the presence of (e.g., by the addition of) an aqueous fluid. Polyurethane-based rubbers traditionally are formed by reacting a polyisocyanate with a polyol. In the embodiments described herein, although non-limiting, the polyol for forming a polyurethane-based rubber may be a natural oil polyol, a polyester polyol (e.g., polybutadienes (e.g., polybutanediol adipate), polycaprolactones, polycarbonates, and the like), or a polyether polyol (e.g., polytetramethylene ether glycol, polyoxypropylene-glycol, polyoxyethylene glycol, and the like). Because polyether polyols are typically hydrolytically more reactive than polyester polyols and natural oil polyols, polyether polyols may be preferred, particularly when the degradation of the degradable elastomer is solely based on aqueous fluid contact and not additionally on other degradation stimuli. However, either polyol may be used to form the polyurethane-based rubber for use as the degradable elastomer described herein, and each is critical to the disclosed embodiments, as the amount of desired degradation over time may depend on a number of factors including the conditions of the subterranean formation, the subterranean formation operation being performed, and the like. Combinations of these polyols may also be used, without departing from the scope of the present disclosure.

Accordingly, the rate of hydrolytic degradation of a polyurethane-based rubber for use as the degradable elastomers described herein may be adjusted and controlled based on the order of the polyol addition, as well as the polyol properties and quantities. As an example, in some embodiments, the amount of polyol is included in an amount in the range of from about 0.25 to about 2 stoichiometric ratio of the polyisocyanate in the polyurethane-based rubber, encompassing any value and subset therebetween. For example, the polyol may be included in an amount of about 0.25 to about 0.5, or about 0.5 to about 1, or about 1 to about 1.5, or about 1.5 to about 2 stoichiometric ratio of the polyisocyanate in the polyurethane-based rubber, encompassing any value and subset therebetween. Each of these values is critical to the embodiments described herein and may depend on a number of factors including, but not limited to, the desired hydrolytic degradation rate, the type of polyol(s) selected, the wellbore environment, and the like.

In some embodiments, where the degradable elastomer selected is a polyurethane-based rubber (e.g., for forming the packer element 220 and/or the frac ball 208), the inclusion of a low functionality initiator may impart flexibility thereto. Such low functionality initiators may include, but are not limited to dipropylene glycol, glycerine, sorbitol/water solution, and any combination thereof. As used herein, the term "low functionality initiator," and grammatical variants thereof, refers to the average number of isocyanate reactive sites per molecule of in the range of from about 1 to about 5. These low functionality initiators impart flexibility to the packer element 220 and may be included in the polyurethane-based rubbers described herein in an amount in the range of from about 1% to about 50% by weight of the polyol in the polyurethane-based rubber, encompassing any value and subset therebetween. For example, the low functionality initiator(s) may be included in the polyurethane-based rubbers in an amount of about 1% to about 12.5%, or about 12.5% to about 25%, or about 25% to about 37.5%, or about 37.5% to about 50% by weight of the polyol in the polyurethane-based rubber, encompassing any value and subset therebetween. Additionally, in some embodiments, higher molecular weight polyols for use in forming the polyurethane-based rubbers described herein may impart flexibility to the packer element 220 described herein. For example, in some embodiments, the molecular weight of the selected polyols may be in the range of from about 200 Daltons (Da) to about 20000 Da, encompassing any value and subset therebetween. For example, the molecular weight of the polyols may be about 200 Da to about 5000 Da, or about 5000 Da to about 10000 Da, or about 10000 Da to about 15000 Da, or about 15000 Da to about 20000 Da, encompassing any value and subset therebetween. Each of these values is critical to the embodiments described herein and may depend on a number of factors including, but not limited to, the desired flexibility of the degradable elastomer (and thus the component at least partially composed thereof), the type of subterranean formation operation being performed, the wellbore environment, and the like.

In some embodiments, the degradable elastomer described herein may be formed from a thiol-based polymer. As used herein, the term "thiol" is equivalent to the term "sulfhydryl." The thiol-based polymer may comprise at least one thiol functional group. In some embodiments, the thiol-based polymer may comprise thiol functional groups in the range of from about 1 to about 22, encompassing every value and subset therebetween. For example, the thiol-based polymer may comprise thiol functional groups in an amount of about 1 to about 5, or 5 to about 10, or 10 to about 15, or 15 to about 20, or 20 to about 22, encompassing any value and subset therebetween. In other embodiments, the thiol-based polymer may comprise even a greater number of thiol functional groups. Each of these values is critical to the embodiments of the present disclosure and may depend on a number of factors including, but not limited to, the desired degradation rate, the desired degradation process, and the like.

The thiol-based polymer may be, but is not limited to, a thiol-ene reaction product, a thiol-yne reaction product, a thiol-epoxy reaction product, and any combination thereof. The thiol-based polymers, whether the reaction product of thiol-ene, thiol-yne, or thiol-epoxy, may be referred to herein as generally being the reaction product of a thiol functional group and an unsaturated functional group, and may be formed by click chemistry. The thiol functional group is an organosulfur compound that contains a carbon-bonded sulfhydryl, represented by the formula —C—SH or R—SH, where R represents an alkane, alkene, or other carbon-containing group of atoms.

Thiol-ene reactions may be characterized as the sulfur version of a hydrosilylation reaction. The thiol-ene reaction product may be formed by the reaction of at least one thiol functional group with a variety of unsaturated functional groups including, but not limited to, a maleimide, an acrylate, a norbornene, a carbon-carbon double bond, a silane, a Michael-type nucleophilic addition, and any combination thereof. As used herein, the term "Michael-type nucleophilic addition," and grammatical variants thereof, refers to the nucleophilic addition of a carbanion or another nucleophile to an α,β-unsaturated carbonyl compound, having the general structure (O═C)—$C^{\alpha}$═$C^{\beta}$—. An example of a suitable thiol-ene reaction product may include, but is not limited to, 1,3,5,-triacryloylhexahydro-1,3,5-triazine. Examples of suitable thiol-ene/silane reaction products that may be used in forming at least a portion of the frac plug 200 or component thereof include, but are not limited to, the following Formulas 1-6:

Formula 1

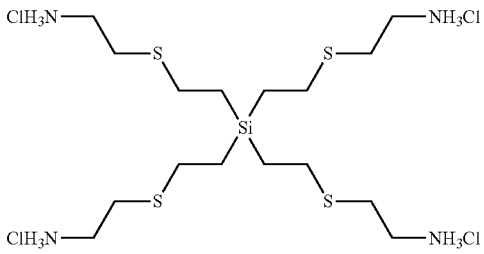

Formula 2

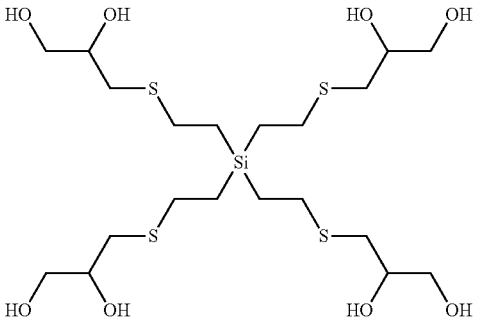

Formula 3

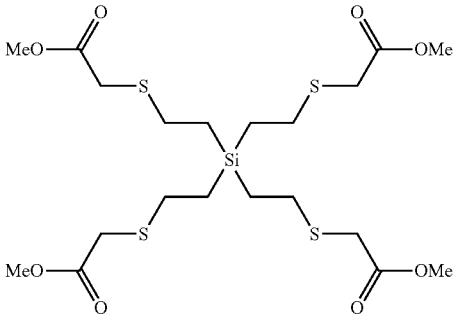

-continued

Formula 4

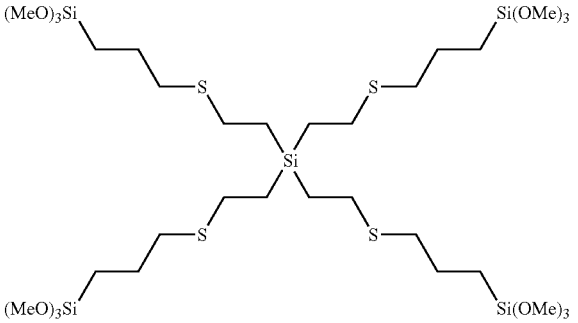

Formula 5

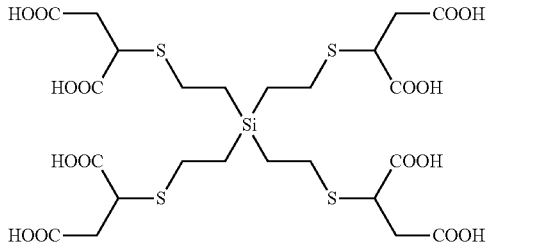

Formula 6

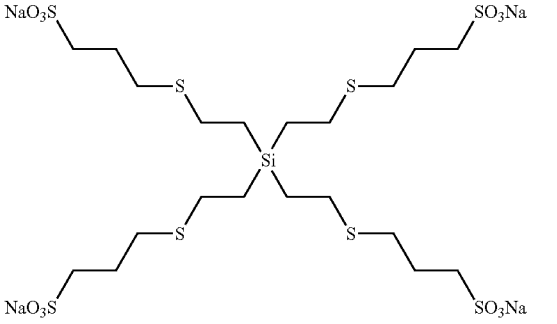

The thiol-yne reaction products may be characterized by an organic addition reaction between a thiol functional group and an alkyne, the alkyne being an unsaturated hydrocarbon having at least one carbon-carbon triple bond. The addition reaction may be facilitated by a radical initiator or UV irradiation and proceeds through a sulfanyl radical species. The reaction may also be amine-mediated, or transition-metal catalyzed.

The thiol-epoxy reaction products may be prepared by a thiol-ene reaction with at least one epoxide functional group. Suitable epoxide functional groups may include, but are not limited to, a glycidyl ether, a glycidyl amine, or as part of an aliphatic ring system. Specific examples of epoxide functional groups may include, but are not limited to, bisphenol-A diglycidyl ether, triglycidylisocyanurate, trimethylolpropane triglycidyl ether, and any combination thereof. The thiol-epoxy reaction products may proceed by one or more of the mechanisms presented below; however, other mechanisms may also be used without departing from the scope of the present disclosure:

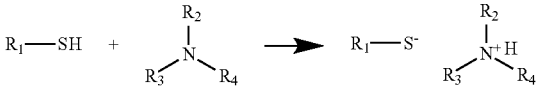

Mechanism 1

-continued

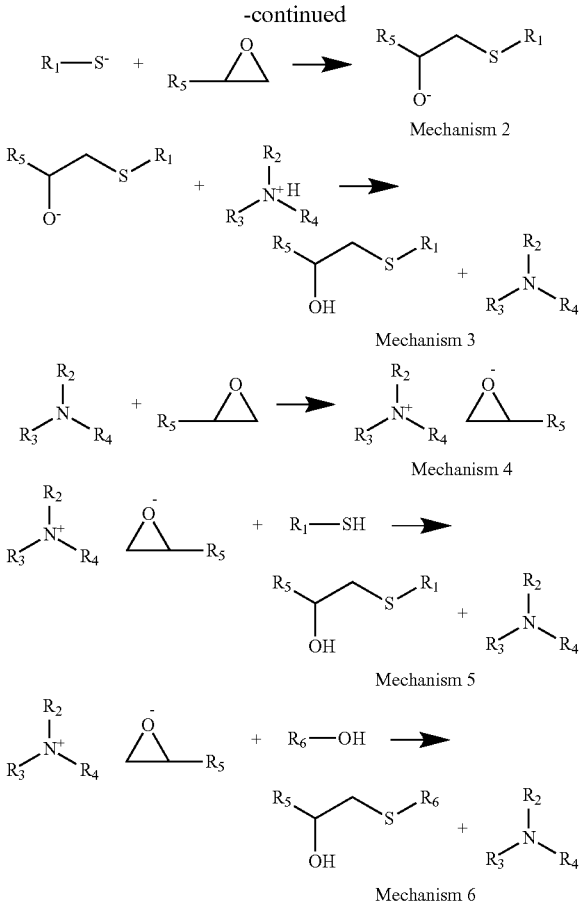

As mentioned above, the thiol-based polymer may comprise at least one thiol functional group and at least one degradable functional group. Such degradable functional groups may include, but are not limited to, one or more of a degradable monomer, a degradable oligomer, or a degradable polymer. Specific examples of degradable functional groups may include, but are not limited to, an acrylate, a lactide, a lactone, a glycolide, an anhydride, a lactam, an allyl, a polyethylene glycol, a polyethylene glycol-based hydrogel, an aerogel, a poly(lactide), a poly(glycolic acid), a poly(vinyl alcohol), a poly(N-isopropylacrylamide), a poly (ε-caprolactone, a poly(hydroxybutyrate), a polyanhydride, an aliphatic polycarbonate, an aromatic polycarbonate, a poly(orthoester), a poly(hydroxyl ester ether), a poly(orthoester), a poly(amino acid), a poly(ethylene oxide), a polyphosphazene, a poly(phenyllactide), a poly(hydroxybutyrate), a dextran, a chitin, a cellulose, a protein, an aliphatic polyester, and any combination thereof.

In some embodiments, the thiol-based polymer comprises at least one polyethylene glycol-based hydrogel, such as one formed by a four-arm polyethylene glycol norbornene that is crosslinked with dithiol containing crosslinkers to form a chemically crosslinked hydrogel to impart swelling properties. The swelling properties of such a hydrogel may vary depending on a number of factors including, but not limited to, network density, the degree of crosslinking, and any combination thereof. In some embodiments, the degree of crosslinking may be desirably increased in order to achieve a higher tensile modulus and reduced swelling percentage.

The frac ball 208 may be composed of the degradable metal material or the degradable elastomer described above. For example, the frac ball 208 may be made of polyglycolic acid (PGA) and/or polylactic acid (PLA). In other embodiments, the frac ball 208 or any other component may be comprised of a degradable material including, but not limited to, the degradable metal materials (e.g., the degradable magnesium and/or aluminum alloys) described above, the degradable elastomers described above, a degradable glass, a dehydrated salt, and any combination thereof. That is, at least a portion of a single component may be composed of more than one degradable material, as described herein. Generally, the degradable metal material, the degradable glass material, and the dehydrated salts are rigid and provide structure, whereas the degradable elastomer is resilient (i.e., elastic), which will dictate the particular components of the frac plug 200 that are composed of either of these materials. Of course, variation in these materials may cause some to fall outside of this generalization, without departing from the scope of the present disclosure. Additionally, in other embodiments, any component of the frac plug 200 may be a degradable non-metal material. Any non-degradable material (e.g., metals, plastics, glass, and the like) may additionally be used to form a component of the frac plug 200.

Examples of suitable degradable glass material may include, but is not limited to, glass polyalkenoate, borate glass polyalkenoate, calcium phosphate glass, polylactic acid/calcium phosphate glass, phosphate glass, silica glass, and any combination thereof. A dehydrated salt is suitable for use in the embodiments of the present disclosure if it will degrade over time as it hydrates. For example, a particulate solid anhydrous borate material that degrades over time may be suitable. Specific examples of particulate solid anhydrous borate materials that may be used include, but are not limited to, anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are highly soluble in water as compared to anhydrous borate materials and as a result degrade in the aqueous fluid. In some instances, the total time required for the anhydrous borate materials to degrade in an aqueous fluid is in the range of from about 8 hours to about 72 hours depending upon the temperature of the subterranean zone in which they are placed. Other examples include organic or inorganic salts like acetate trihydrate.

In some embodiments, the degradable elastomer forming one or more components of the frac plug 200 (e.g., at least the mandrel 206 and/or the slips 216*a,b*) may have a thermoplastic polymer embedded therein. In some instances, the degradable elastomer is itself a thermoplastic, in which case a different thermoplastic polymer may be embedded therein, in accordance with the embodiments described herein. That is, the thermoplastic material may serve as an elastomer for forming one or more components of the frac plug 200 alone or in combination, without departing from the scope of the present disclosure. The thermoplastic polymer may modify the strength, resiliency, or modulus of a component of the frac plug 200 (e.g., the packer element 220 and/or frac ball 208) and may also control the degradation rate thereof. Suitable thermoplastic polymers may include, but are not limited to, polypropylene, an aliphatic polyester (e.g., polyglycolic acid, polylactic acid, polycaprolactone, polyhydroxyalkanoate, polyhydroxyalkanoiate, polyhydroxybutyrate, polyethylene adipate, polybutylene succinate, poly(lactic-co-glycolic) acid, poly(3-hydroxybutyrate-co-3-hyroxyvalerate, polycarbonate, and the like), and any combination thereof. In some situations, as stated above, the degradable substance may be a thermoplastic, which may be combined with one or more other degradable substances (in combination) or a thermoplastic listed above.

The amount of thermoplastic polymer that may be embedded in the degradable elastomer is selected to confer a desirable quality (e.g., elasticity) without affecting the desired amount of degradation. In some embodiments, the thermoplastic polymer may be included in an amount in the range of from about 1% to about 91% by weight of the degradable elastomer, encompassing any value or subset therebetween. For example, the thermoplastic polymer may be included in an amount of about 1% to about 25%, or about 25% to about 50%, or about 50% to about 75%, or about 75% to about 91% by weight of the degradable elastomer, encompassing any value or subset therebetween. Each of these values is critical to the embodiments described herein and may depend on a number of factors including, but not limited to, the desired flexibility of the degradable elastomer, the desired degradation rate of the degradable substance, the wellbore environment, and the like, and combinations thereof.

A reinforcing agent may additionally be included in the degradable elastomer, which may increase the strength, stiffness, or salt creep resistance of the component of the frac plug 200 comprising at least a portion of the degradable elastomer. Such reinforcing agents may be a particulate, a fiber, a fiber weaver, and any combination thereof.

The particulate may be of any size suitable for embedding in the degradable elastomer, such as in the range of from about 400 mesh to about 40 mesh, U.S. Sieve Series, and encompassing any value or subset therebetween. For example, the size of particulate for embedding in the degradable elastomer may be in the range of about 400 mesh to about 300 mesh, or about 300 mesh to about 200 mesh, or about 200 mesh to about 100 mesh, or about 100 mesh to about 40 mesh, encompassing any value and subset therebetween. Moreover, there is no need for the particulates to be sieved or screened to a particular or specific particle mesh size or particular particle size distribution, but rather a wide or broad particle size distribution can be used, although a narrow particle size distribution is also suitable.

In some embodiments, the particulates may be substantially spherical or non-spherical. Substantially non-spherical proppant particulates may be cubic, polygonal, or any other non-spherical shape. Such substantially non-spherical particulates may be, for example, cubic-shaped, rectangular-shaped, rod-shaped, ellipse-shaped, cone-shaped, pyramid-shaped, planar-shaped, oblate-shaped, or cylinder-shaped. That is, in embodiments wherein the particulates are substantially non-spherical, the aspect ratio of the material may range such that the material is planar to such that it is cubic, octagonal, or any other configuration.

Particulates suitable for use as reinforcing agents in the embodiments described herein may comprise any material suitable for use in the degradable elastomer that provides one or more of stiffness, strength, or creep resistance, or any other added benefit. Suitable materials for these particulates may include, but are not limited to, organophilic clay, silica flour, metal oxide, sand, bauxite, ceramic materials, glass materials, polymer materials (e.g., ethylene vinyl acetate or composite materials), polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof. Suitable composite particulates may comprise a binder and a filler material wherein suitable filler materials include silica, alumina, fumed carbon, carbon black, graphite, mica, titanium dioxide, barite, meta-silicate, calcium silicate, kaolin, talc, zirconia, boron, fly ash, hollow glass microspheres, solid glass, and combinations thereof.

The fibers for use as reinforcing agents in the degradable elastomer may be of any size and material capable of being included therein. In some embodiments, the fibers may have a length of less than about 1.25 inches and a width of less than about 0.01 inches. In some embodiments, a mixture of different sizes of fibers may be used. Suitable fibers may be formed from any material suitable for use as a particulate, as described previously, as well as materials including, but not limited to, carbon fibers, carbon nanotubes, graphene, fullerene, a ceramic fiber, a plastic fiber, a glass fiber, a metal fiber, and any combination thereof. In some embodiments, the fibers may be woven together to form a fiber weave for use in the degradable elastomer.

In some embodiments, the reinforcing agent may be included in the degradable elastomer in an amount in the range of from about 1% to about 91% by weight of the degradable elastomer, encompassing any value or subset therebetween. For example, the reinforcing agent may be included in an amount of about 1% to about 25%, or about 25% to about 50%, or about 50% to about 75%, or about 75% to about 91% by weight of the degradable elastomer encompassing any value or subset therebetween. Each of these values is critical to the embodiments of the present disclosure and may depend on a number of factors including, but not limited to, the desired stiffness of the degradable elastomer, the desired strength of the degradable elastomer, the desired salt creep resistance of the degradable elastomer, the type of degradable elastomer selected, and the like, and any combination thereof.

According to an embodiment, each of the degradable substance(s) may include one or more tracers present therein. The tracer(s) can be, without limitation, radioactive, chemical, electronic, or acoustic. A tracer can be useful in determining real-time information on the rate of dissolution of the degradable substance. By being able to monitor the presence of the tracer, workers at the surface can make on-the-fly decisions that can affect the rate of dissolution of the remaining portions of the frac plug 200.

In some embodiments, the degradable substance may be at least partially encapsulated in a second material or "sheath" disposed on all or a portion of a given component of the frac plug 200. The sheath may be configured to help prolong degradation of the given component of the frac plug 200. The sheath may also serve to protect the component from abrasion within the wellbore 106. The sheath may be permeable, frangible (e.g., as discussed previously with regard to compressing the packer element 220 against the casing or wall of the wellbore), or comprise a material that is at least partially removable at a desired rate within the wellbore environment. In either scenario, the sheath may be designed such that it does not interfere with the ability of the frac plug 200 to form a fluid seal in the wellbore 106.

The sheath may comprise any material capable of use in a downhole environment and, depending on the component that the sheath encapsulates, the sheath may or may not be elastic such that it is able to expand with corresponding expansion of the component. For instance, a frangible sheath may break as the packer elements 220 expand to form a fluid seal by compressing against a casing or wall of a wellbore, whereas a permeable sheath may remain in place on the packer elements 220 as they form the fluid seal. As used herein, the term "permeable" refers to a structure that permits fluids (including liquids and gases) therethrough and is not limited to any particular configuration.

The sheath may comprise any of the afore-mentioned degradable substances. In some embodiments, the sheath may be made of a degradable substance that degrades at a rate that is faster than that of the underlying degradable substance that forms the component. Other suitable materials for the sheath include, but are not limited to, a TEFLON® coating, a wax, a drying oil, a polyurethane, an epoxy, a cross-linked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof.

In some embodiments, all or a portion of the outer surface of a given component of the frac plug 200 may be treated to impede degradation. For example, the outer surface of a given component may undergo a treatment that aids in preventing the degradable substance from degrading, or that aids in reducing the degradation rate. Suitable treatments may include, but are not limited to, an anodizing treatment, an oxidation treatment, a chromate conversion treatment, a dichromate treatment, a fluoride anodizing treatment, a hard anodizing treatment, and any combination thereof. As an example, an anodizing treatment may result in an anodized layer of material being deposited on the outer surface of a given component. The anodized layer may comprise materials such as, but not limited to, ceramics, metals, polymers, epoxies, elastomers, plastics, or any combination thereof and may be applied using any suitable processes known to those of skill in the art. Examples of suitable processes that result in an anodized layer include, but are not limited to, soft anodized coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of a given component of the frac plug 200 may be treated or coated with a substance configured to enhance degradation of the degradable material. For example, such a treatment or coating may be configured to remove a protective coating or treatment or otherwise accelerate the degradation of the degradable substance of the given component. An example is a degradable metal material coated with a layer of polyglycolic acid (PGA). In this example, the PGA would undergo hydrolysis and cause the surrounding fluid to become more acidic, which would accelerate the degradation of the underlying degradable metal material.

Embodiments disclosed herein include Embodiment A and Embodiment B:

Embodiment A: A method comprising: (a) introducing a frac plug into a wellbore in a subterranean formation, the frac plug comprising at least a mandrel, slips, and a packer element, wherein at least a portion of the mandrel and/or the slips is composed of a degradable alloy selected from the group consisting of a magnesium alloy, an aluminum alloy, and any combination thereof; (b) frictionally engaging the slips with a casing string in the subterranean formation; (c) compressing the packer element against the casing string to set the frac plug; (d) creating at least one perforation into the subterranean formation; (e) hydraulically fracturing the subterranean formation; (f) at least partially degrading the degradable alloy upon contact with an electrolyte in the wellbore; and (g) producing a hydrocarbon from the subterranean formation.

Embodiment B: A method comprising: (a) introducing a frac plug into a wellbore in a subterranean formation, the frac plug comprising at least a mandrel, slips, and a packer element, wherein at least a portion of the mandrel and/or the slips is composed of a degradable alloy selected from the group consisting of a magnesium alloy, an aluminum alloy, and any combination thereof; (b) frictionally engaging the slips with a wall of the wellbore; (c) compressing the packer element against the wall of the wellbore to set the frac plug; (d) creating at least one perforation into the subterranean formation; (e) hydraulically fracturing the subterranean formation; (f) at least partially degrading the degradable alloy upon contact with an electrolyte in the wellbore; and (g) producing a hydrocarbon from the subterranean formation.

Each of Embodiments A and B may have one or more of the following additional elements in any combination:

Element 1: Wherein the packer element is at least partially composed of a degradable elastomer.

Element 2: Wherein step (f) begins before step (g) begins, or wherein step (g) begins before step (f) begins.

Element 3: Wherein there is no wellbore intervention for purposes of removing the frac plug or debris from the frac plug from the wellbore beyond the frac plug into the wellbore between steps (e) and (f), and/or between steps (f) and (g).

Element 4: Wherein there is no wellbore intervention for purposes of removing the frac plug or debris from the frac plug from the wellbore between steps (e) and (f), and/or between steps (f) and (g).

Element 5: Wherein there is no wellbore intervention for purposes of removing the frac plug or debris from the frac plug from the wellbore beyond the frac plug into the wellbore between the steps of (e) and (g), and wherein either of steps (f) or (g) begins prior to the other.

Element 6: Wherein there is no wellbore intervention for purposes of removing the frac plug or debris from the frac plug from the wellbore between the steps of (e) and (g), and wherein either of steps (f) or (g) begins prior to the other.

Element 7: Wherein the packer element is compressed by stroking the mandrel on the frac plug.

Element 8: Wherein the packer element is compressed by rupturing a frangible barrier disposed at least partially about the packer element.

Element 9: Further comprising seating a degradable metal ball on a ball seat of the frac plug to create a fluid seal in the wellbore.

Element 10: Further comprising seating a degradable elastomer ball on a ball seat of the frac plug to create a fluid seal in the wellbore.

Element 11: Wherein the frac plug further comprises a component selected from the group consisting of at least one slip wedge, at least one spacer ring, a mule shoe, and any combination thereof, and wherein one or more of the components is composed of the degradable alloy.

By way of non-limiting example, exemplary combinations applicable to Embodiment A and/or B include: 1-11; 2, 3, and 8; 3, 6, 7, and 9; 2, 7, 8, and 10; 5, 6, and 8; 3, 9, and 11; 5, 6, 7, and 11; 2 and 7; 4 and 8; 1, 4, and 5; 3, 9, and 10; and the like.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method comprising:

(a) introducing a frac plug into a wellbore in a subterranean formation, the frac plug comprising at least a mandrel, slips, and a packer element, wherein:
  at least a portion of the mandrel and/or the slips is composed of a degradable alloy selected from the group consisting of a magnesium alloy, an aluminum alloy, and any combination thereof; and
  at least a portion of the frac plug comprises a non-metal degradable material having a same degradation rate as the degradable alloy, the degradation rate being about 0.1% to about 10% of total mass per day at 93° C. in a 15% KCl solution;
(b) frictionally engaging the slips with a casing string in the subterranean formation;
(c) compressing the packer element against the casing string to set the frac plug;
(d) creating at least one perforation into the subterranean formation;
(e) hydraulically fracturing the subterranean formation;
(f) at least partially degrading the degradable alloy upon contact with an electrolyte in the wellbore; and
(g) producing a hydrocarbon from the subterranean formation.

2. The method of claim 1, wherein the packer element is at least partially composed of a degradable elastomer.

3. The method of claim 1, wherein step (f) begins before step (g) begins, or wherein step (g) begins before step (f) begins.

4. The method of claim 1, wherein there is no wellbore intervention for purposes of removing the frac plug or debris from the frac plug from the wellbore between steps (e) and (f), and/or between steps (f) and (g).

5. The method of claim 1, wherein there is no wellbore intervention for purposes of removing the frac plug or debris from the frac plug from the wellbore between the steps of (e) and (g), and wherein either of steps (f) or (g) begins prior to the other.

6. The method of claim 1, wherein the packer element is compressed by stroking the mandrel on the frac plug.

7. The method of claim 1, wherein the packer element is compressed by rupturing a frangible barrier disposed at least partially about the packer element.

8. The method of claim 1, further comprising seating a degradable metal ball on a ball seat of the frac plug to create a fluid seal in the wellbore.

9. The method of claim 1, further comprising seating a degradable elastomer ball on a ball seat of the frac plug to create a fluid seal in the wellbore.

10. The method of claim 1, wherein the frac plug further comprises a component selected from the group consisting of at least one slip wedge, at least one spacer ring, a mule shoe, and any combination thereof, and wherein one or more of the components is composed of the degradable alloy.

11. A method comprising:

(a) introducing a frac plug into a wellbore in a subterranean formation, the frac plug comprising at least a mandrel, slips, and a packer element, wherein:
  at least a portion of the mandrel and/or the slips is composed of a degradable alloy selected from the group consisting of a magnesium alloy, an aluminum alloy, and any combination thereof; and
  at least a portion of the frac plug comprises a non-metal degradable material having a same degradation rate as the degradable alloy, the degradation rate being about 0.1% to about 10% of total mass per day at 93° C. in a 15% KCl solution;
(b) frictionally engaging the slips with a wall of the wellbore;
(c) compressing the packer element against the wall of the wellbore to set the frac plug;
(d) creating at least one perforation into the subterranean formation;
(e) hydraulically fracturing the subterranean formation;
(f) at least partially degrading the degradable alloy upon contact with an electrolyte in the wellbore; and
(g) producing a hydrocarbon from the subterranean formation.

12. The method of claim 11, wherein the packer element is at least partially composed of a degradable elastomer.

13. The method of claim 11, wherein step (f) begins before step (g) begins, or wherein step (g) begins before step (f) begins.

14. The method of claim 11, wherein there is no wellbore intervention for purposes of removing the frac plug or debris from the frac plug from the wellbore between steps (e) and (f), and/or between steps (f) and (g).

15. The method of claim 11, wherein there is no wellbore intervention for purposes of removing the frac plug or debris from the frac plug from the wellbore between the steps of (e) and (g), and wherein either of steps (f) or (g) begins prior to the other.

16. The method of claim 11, wherein the packer element is compressed by stroking the mandrel on the frac plug.

17. The method of claim 11, wherein the packer element is compressed by rupturing a frangible barrier disposed at least partially about the packer element.

18. The method of claim 11, further comprising seating a degradable metal ball on a ball seat of the frac plug to create a fluid seal in the wellbore.

19. The method of claim 11, further comprising seating a degradable elastomer ball on a ball seat of the frac plug to create a fluid seal in the wellbore.

20. The method of claim 11, wherein the frac plug further comprises a component selected from the group consisting of at least one slip wedge, at least one spacer ring, a mule shoe, and any combination thereof, and wherein one or more of the components is composed of the degradable alloy.

* * * * *